US012655737B1

(12) United States Patent
Smith

(10) Patent No.: US 12,655,737 B1
(45) Date of Patent: Jun. 16, 2026

(54) PRESSURE CONTROL ASSEMBLY FOR COMPARTMENTALIZED HYDRAULIC FRACTURING

(71) Applicant: Typhon Technology Solutions (U.S.), LLC, The Woodlands, TX (US)

(72) Inventor: Jason David Smith, Conroe, TX (US)

(73) Assignee: Typhon Technology Solutions (U.S.), LLC, The Woodlands, TX (US)

( * ) Notice: Subject to any disclaimer, the term of this patent is extended or adjusted under 35 U.S.C. 154(b) by 0 days.

(21) Appl. No.: 19/388,601

(22) Filed: Nov. 13, 2025

(51) Int. Cl.
*E21B 43/26* (2006.01)
*E21B 34/16* (2006.01)
*E21B 43/14* (2006.01)

(52) U.S. Cl.
CPC ..... *E21B 43/2607* (2020.05); *E21B 34/16* (2013.01); *E21B 43/14* (2013.01); *E21B 2200/05* (2020.05)

(58) Field of Classification Search
CPC ..... E21B 43/2607; E21B 34/16; E21B 43/14
USPC ..... 166/308.1
See application file for complete search history.

(56) References Cited

U.S. PATENT DOCUMENTS

| | | | | |
|---|---|---|---|---|
| 11,808,126 | B2 * | 11/2023 | Cook | E21B 43/2607 |
| 11,851,989 | B2 * | 12/2023 | Almarri | E21B 36/001 |
| 2021/0131261 | A1 * | 5/2021 | Wang | E21B 43/261 |
| 2022/0090475 | A1 * | 3/2022 | Radwan | E21B 33/138 |

* cited by examiner

*Primary Examiner* — William D Hutton, Jr.
*Assistant Examiner* — Ashish K Varma
(74) *Attorney, Agent, or Firm* — Fenwick & West LLP

(57) ABSTRACT

A compartmentalized hydraulic fracturing system enables selective isolation, maintenance, and reactivation of individual zones without interrupting overall pumping operations. Each zone includes one or more frac pumps that discharge into a mono line through a pressure control assembly having a hydraulically actuated gate valve and a passive one-way isolation valve arranged in series. The passive isolation valve, which may include a flapper-type check mechanism, automatically opens when pump-side pressure exceeds mono-line pressure by a cracking pressure and closes to prevent backflow when the differential reverses. A bleed assembly may provide controlled depressurization of each isolated zone. A control system may deactivate and reactivate zones automatically based on pressure data and valve states, maintaining redundant barriers and enabling safe, rapid service of individual compartments while minimizing downtime in high pressure hydraulic fracturing operations.

16 Claims, 19 Drawing Sheets

PRESSURE CONTROL ASSEMBLY (HORIZONTAL CONFIGURATION)

PRESSURE CONTROL ASSEMBLY FOR COMPARTMENTALIZED HYDRAULIC FRACTURING

TECHNICAL FIELD

This disclosure relates generally to hydraulic fracturing (frac) systems, and more specifically, to systems for minimizing downtime for fracturing operations.

BACKGROUND

Hydraulic fracturing, or fracking, is a process utilized in the extraction of oil and natural gas stored in deep geologic formations. Fracking methodology involves the injection of high-pressure fluids into a wellbore to create small fractures and fissures in the rock formation. This process enables natural gas or oil to flow out of the well more freely. This is typically achieved using powerful hydraulic fracturing pump trailers, which generate and maintain the immense pressures required for the operation.

BRIEF DESCRIPTION OF DRAWINGS

The disclosed embodiments have other advantages and features which will be more readily apparent from the detailed description, the appended claims, and the accompanying figures (or drawings). A brief introduction of the figures is below.

DETAILED DESCRIPTION

Figure 1:
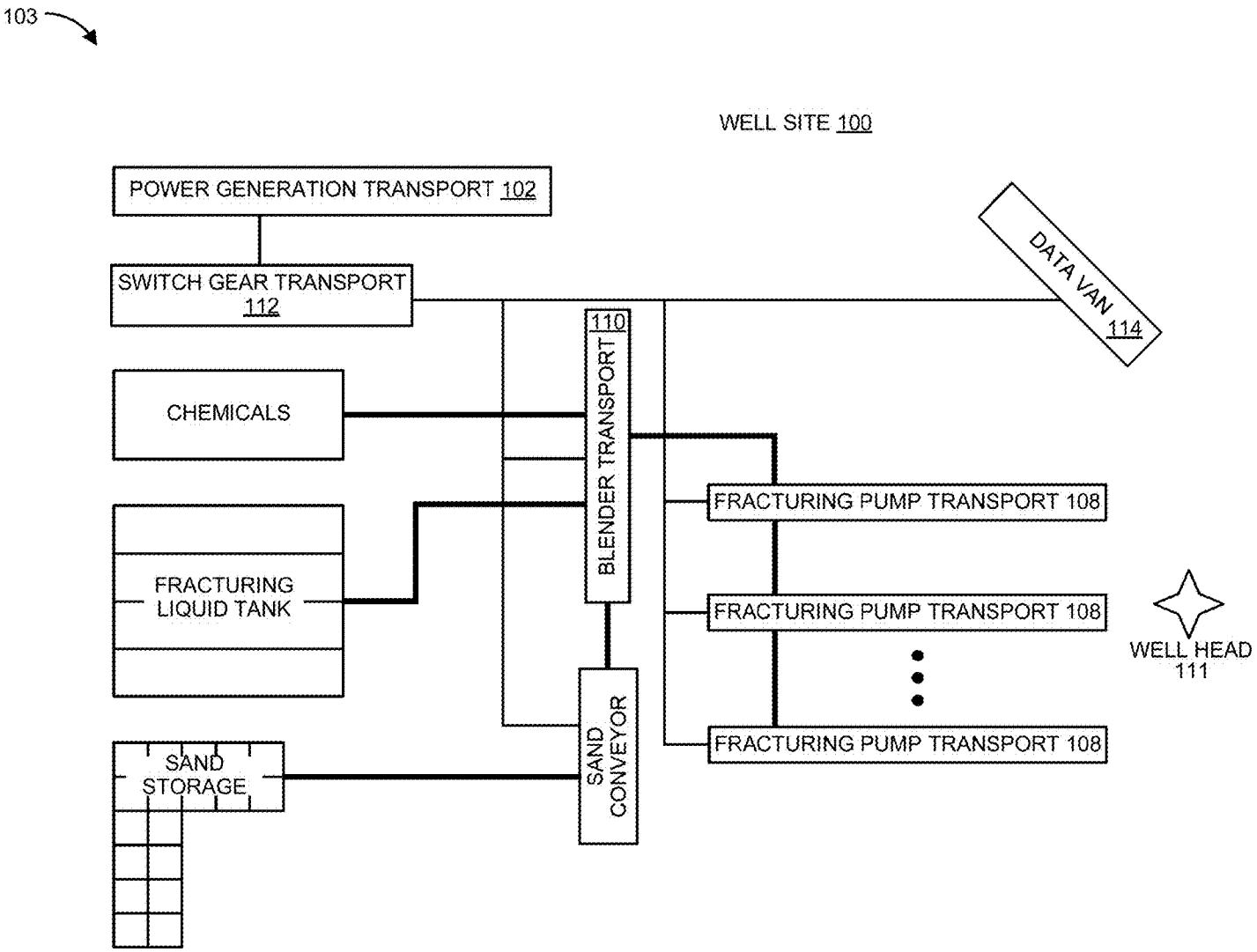
FIG. 1 is a schematic diagram of a mobile hydraulic fracturing system operating at a well site, in accordance with one or more embodiments.

The Figures (FIGS.) and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

In the following description, for purposes of explanation, numerous specific details are set forth to provide a thorough understanding of the inventive concept. In the interest of clarity, not all features of an actual implementation are described. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" or "another embodiment" means that a particular feature, structure, or characteristic described in connection with the embodiment is included in at least one embodiment of the invention, and multiple references to "one embodiment" or "an embodiment" or "another embodiment" should not be understood as necessarily all referring to the same embodiment.

The terms "a," "an," and "the" are not intended to refer to a singular entity unless explicitly so defined but include the general class of which a specific example may be used for illustration. The use of the terms "a" or "an" may therefore mean any number that is at least one, including "one," "one or more," "at least one," and "one or more than one." The term "or" means any of the alternatives and any combination of the alternatives, including all the alternatives, unless the alternatives are explicitly indicated as mutually exclusive. The phrase "at least one of" when combined with a list of items, means a single item from the list or any combination of items in the list. The phrase does not require all the listed items unless explicitly so defined.

As used herein, the term "transport" refers to any transportation assembly, including, but not limited to, a trailer, truck, skid, and/or barge used to transport heavy structures, such as a gas turbine, a generator, a power generation system, an air handling system, and the like.

As used herein, the term "trailer" refers to a transportation assembly used to transport heavy structures, such as a gas turbine, a generator, a power generation system, an air handling system, and the like, that can be attached and/or detached from a transportation vehicle used to pull or move the trailer. In one embodiment, the trailer may include the mounts and manifold systems to connect the trailer to other equipment.

Configuration Overview

Hydraulic fracturing operations utilize powerful pumping equipment capable of generating and sustaining extremely high pressures to inject fracturing fluid into a wellbore. The area surrounding this high-pressure equipment, often referred to as the "red zone," can present elevated safety risks due to the potential for leaks, ruptures, or mechanical failures. High pressure components can experience forces that transform even small fittings into dangerous projectiles, creating potential hazards for nearby personnel and equipment.

To ensure safety, fracturing operations typically employ strict procedures requiring all pumping activity to cease before maintenance or repair work begins in or near the red zone. While effective for safety, such full system shutdowns can increase operational downtime and cost. Accordingly, there is a continued need for pressure control arrangements that allow a portion of the system to be safely isolated for maintenance while the remainder remains operational.

To overcome problems associated with conventional systems, a compartmentalized hydraulic fracturing system according to the present disclosure may divide a fracturing fleet operation into multiple zones. Each zone (also "compartment") may include at least one frac pump trailer or transport and each frac pump trailer may include at least one frac pump. For a service event (e.g., due to a component failure or scheduled maintenance), service personnel and/or a control system may selectively deactivate (also "shut down" or "taken offline") a particular zone while the other zones remain operational. That is, each zone can be selectively isolated from the main flow line, such as a mono line that carries fracturing fluid toward a wellhead, while other zones can continue operating. After deactivating the zone (e.g., including deenergizing equipment within the zone), service personnel can (e.g., safely) enter the zone while the other zones continue to pump high-pressure frac fluid downhole at the desired flow rate or pressure. "High-pressure" fluid may refer to fluid downstream of a pump or pump trailer. Example high-pressures include pressures in the range of 300-15,000 PSI (pounds per square inch) or even higher, such as 20,000 PSI or greater. Examples of high-pressure systems include the flow line iron and well head equipment (which are downstream of the frac pumps). Similarly, "low-pressure" fluid may refer to fluid upstream of a pump or pump trailer. Example low-pressures include pressures in the range of 0-300 PSI, and examples of low pressure systems include the water transfer, blender, and piping supply systems (that are upstream of the frac pumps).

Each zone may include one or more pressure control assemblies. Each pressure control assembly may include valves arranged in series to control fluid communication between the pumps and the main line, as well as one or more bleed off pathways for controlled depressurization of the zone. In some embodiments, a pressure control assembly for a given zone may include a first valve configured to open automatically in response to a pressure differential across the valve and to close automatically to prevent reverse flow from the main line into the zone, and a second valve that may be actuated hydraulically, electrically, or mechanically to selectively permit or block flow. The combination of an actively controlled isolation valve and a passively controlled one-way isolation valve may provide redundant barriers while allowing simplified deactivation of a zone for maintenance or reactivation of the zone once maintenance is complete. For example, the passive operation of the one-way valve can reduce or eliminate the need for manual pressure equalization procedures based on a pressure differential between the downstream pressure (e.g., main line pressure) and the upstream pressure (e.g., pressure between the pumps and the pressure control assembly of a given zone), thereby improving reliability and reducing time required to bring a zone back online.

Each zone may also include one or more bleed valves or bleed-off assemblies configured to relieve trapped pressure in a controlled manner. In some embodiments, a bleed-off assembly may incorporate a restricted flow path, such as a choke, for gradual pressure reduction, along with a bypass pathway for faster venting after the pressure has fallen below a target level. The particular arrangement and valve types can vary according to design requirements, fluid pressure ratings, or desired redundancy.

Deactivation or reactivation of zones of the compartmentalized frac system may be automated by a control system. The control system may monitor and coordinate the operation of the zones, including controlling valve positions, pump speeds, or bleed-off sequences. The control system may receive data from pressure or flow sensors associated with the valves or lines of each zone and may automatically or semi-automatically deactivate, isolate, or reactivate a selected zone. During such transitions, the control system can regulate pressures in the active zones to maintain a substantially constant downhole rate or pressure.

By incorporating multiple independently controllable pressure control assemblies, the compartmentalized fracturing system can enable selective zone isolation, simplify maintenance procedures, and reduce the downtime associated with high pressure operations. The system may be implemented using a variety of valve types, actuation methods, and pressure relief mechanisms suited to the desired operating pressures and flow conditions.

The compartmentalized frac system may enable remote deactivation (e.g., including de-energization) or reactivation (e.g., including re-energization) of the selected zone where a frac pump (e.g., on which maintenance or failure operations need to be performed) is located. The system may include components for isolating, bleeding, priming, or any combination thereof, each zone and sensors to measure sensor data from each zone to remotely deactivate or reactivate the selected zone. A deactivated zone may enable service personnel to enter the zone (e.g., safely), and perform the desired service (e.g., failure correction work). After the service work is complete, the compartmentalized frac system may reactivate the zone by ramping pressure back up from the zone and restart sending high-pressure frac fluid downhole from that zone. Other zones may continue to send high-pressure frac fluid downhole (e.g., at an increased flow rate) to maintain target downhole pressure and rate while a zone being serviced is offline.

The compartmentalized frac system may include components to turn off the (e.g., high-voltage) power line feeding power to the electric motors driving the frac pumps on the one or more pump trailers located in the selected zone being deactivated. The system may also include partition walls between zones to prevent a pressure leak or other hazard from the red zone from harming personnel working in an adjacent deactivated zone.

The compartmentalized frac system (e.g., via a control system) may selectively and individually adjust rates (or pressures) across zones so that a target downhole rate (or pressure) is maintained (e.g., within a threshold range that depends on operations of the well site (e.g., within +/−2000 psi of the treating pressure or +/−7 bbls (barrels per second) of down hole rate)) even when one or more zones are temporarily deactivated for service. The system may be configured to ramp up or ramp down the rate (or pressure) from one or more of the other zones as a selected zone is being deactivated and when it is being reactivated (also referred to as "brought back online"). The system may enable automation or semi-automation of the frac system. For example, upon detection of a service event (e.g., a failure event) in a particular zone, the system may autonomously or semi-autonomously take steps to deactivate the zone while ramping up the flow rate (or pressure) from one or more of the other zones to maintain downhole rate (or pressure). The system may notify an operator when a zone is fully deactivated and ready for entry by service personnel to perform the desired work.

Other aspects include components, devices, systems, improvements, methods, processes, applications, computer readable mediums, and other technologies related to any of the above.

Example Mobile Hydraulic Fracturing System

FIG. 1 is a schematic diagram of a mobile hydraulic fracturing system 103 operating at a well site 100, in accordance with one or more embodiments. The well site 100 comprises a wellhead 111 (e.g., frac pad including multiple wells) and the mobile fracturing system 103 (e.g., hydraulic fracturing fleet, frac fleet or system). Generally, the mobile fracturing system 103 may perform fracturing operations to complete a well and/or transform a drilled well into a production well. For example, the well site 100 may be a site where operators are in the process of drilling and completing a well. Operators may start the well completion process (e.g., well completion operation) after drilling, running production casing, and cementing within the wellbore. The operators may also insert a variety of downhole tools into the wellbore and/or as part of a tool string used to drill the wellbore. After the operators drill the well to a certain depth, a horizontal portion of the well may also be drilled and subsequently encased in cement. The operators may subsequently remove the rig, and the mobile fracturing system 103 may be moved onto the well site 100 to perform the well completion operation (e.g., fracturing operation) that forces relatively high-pressure fracturing fluid through the wellhead 111 into subsurface geological formations to create fissures and cracks within the rock. The mobile fracturing system 103 may be moved off the well site 100 once the operators complete the well completion operation. Typically, the well completion operation for the well site 100 may last several days and even up to multiple months.

In one or more embodiments, the mobile fracturing system 103 may comprise a power generation transport 102 (e.g., mobile source of electricity; power generation system; turbine-electric generator transport; inlet and exhaust transport) configured to generate electricity by converting hydrocarbon fuel, such as natural gas, obtained from one or more sources (e.g., a producing wellhead) at the well site 100, from a remote offsite location, and/or another relatively convenient location near the power generation transport 102. That is, the mobile fracturing system 103 may utilize the power generation transport 102 as a power source that burns cleaner while being transportable along with other fracturing equipment. The generated electricity from the power generation transport 102 may be supplied to fracturing equipment to power fracturing operations at one or more well sites, or to other equipment in various types of applications requiring mobile electric power generation.

The power generation transport 102 may be implemented as a single-trailer power generation transport. In one or more embodiments, the power generation transport 102 may be implemented using two or more transports, and components of the power generation transport 102 may be arranged on the two or more transports in any reasonable manner. For example, the power generation transport 102 may be implemented using a two-transport design in which a first transport may comprise a turbine (e.g., gas turbine) and a generator, and a second transport may comprise an air filter box providing filtered combustion air for the turbine, and an exhaust stack that securely provides an exhaust system for combustion exhaust air from the turbine. As another example, the power generation transport 102 may be implemented using a three-transport design in which a first transport may include a gas turbine and an exhaust stack, a second transport may include a generator, and a third transport may include an air handling system that provides filtered intake air for combustion by the turbine.

Although not shown in FIG. 1, the power generation transport or system 102 may include a variety of equipment for mobile electric power generation including a gas conditioning skid, a black start generator, a power source (e.g., gas turbine), a power source air inlet filter housing, a power source inlet plenum, a power source exhaust collector, an exhaust coupling member, a power source exhaust stack, a gearbox, a generator shaft, a generator, a generator air inlet filter housing, a generator ventilation outlet, a generator breaker, a transformer, a starter motor, and a control system. Other components on the power generation transport 102 may include a turbine lube oil system, a fire suppression system, a generator lube oil system, and the like.

In one or more embodiments, the power source may be a gas turbine. In another embodiment, power source may be another type of power source (e.g., diesel engine, internal combustion engine). The gas turbine may generate mechanical energy (e.g., rotation of a shaft) from a hydrocarbon fuel source, such as natural gas, liquefied natural gas, condensate, and/or other liquid fuels. For example, a shaft of the gas turbine may be connected to the gearbox and the generator such that the generator converts the supplied mechanical energy from the rotation of the shaft of the gas turbine to produce electric power. The gas turbine may be a commercially available gas turbine such as a General Electric NovaLT5 gas turbine, a Pratt and Whitney gas turbine, or any other similar gas turbine. The generator may be a commercially available generator such as a Brush generator, a WEG generator, or other similar generator configured to generate a compatible amount of electric power. For example, the combination of the gas turbine, the gearbox, and the generator within power generation transport 102 may generate electric power from a range of at least about 1 megawatt (MW) to about 75 MW (e.g., 5.6 MW, 32 MW, or 48 MW). Other types of gas turbine/generator combinations with power ranges greater than about 75 MW or less than about 1 MW may also be used depending on the application requirement.

In addition to the power generation transport 102, the mobile fracturing system 103 may include a switch gear transport 112, at least one blender transport 110, at least one data van 114, and one or more fracturing pump transports 108 that deliver fracturing fluid through the wellhead 111 to the subsurface geological formations. The switch gear transport 112 may receive electricity generated by the power generation transport 102 via one or more electrical connections. In one embodiment, the switch gear transport 112 may use 13.8 kilovolts (KV) electrical connections to receive power from the power generation transport 102. The switch gear transport 112 may transfer the electricity received from the power generation transport 102 to electrically connected fracturing equipment of the mobile fracturing system 103. The switch gear transport 112 may comprise a plurality of electrical disconnect switches, fuses, transformers, and/or circuit protectors to protect the fracturing equipment. In some embodiments, switch gear transport 112 may be configured to step down a voltage received from the power generation transport 102 to one or more lower voltages to power the fracturing equipment.

Each fracturing pump transport 108 may receive electric power from the switch gear transport 112 to power a prime mover. The prime mover converts electric power to mechanical power for driving one or more fracturing pumps of the fracturing pump transport 108. In one embodiment, the prime mover may be a dual shaft electric motor that drives two different frac pumps mounted to each fracturing pump transport 108. Each fracturing pump transport 108 may be arranged such that one frac pump is coupled to opposite ends of the dual shaft electric motor and avoids coupling the pumps in series. By avoiding coupling the pump in series, fracturing pump transport 108 may continue to operate when either one of the pumps fails or has been removed from the fracturing pump transport 108. Additionally, repairs to the pumps may be performed without disconnecting the system manifolds that connect the fracturing pump transport 108 to other fracturing equipment within the mobile fracturing system 103 and the wellhead 111. The fracturing pump transport 108 may implement (in whole or in part) a system for predicting frac pump component life intervals and setting a continuous completion event for a well completion design.

The blender transport 110 may receive electric power fed through the switch gear transport 112 to power a plurality of electric blenders. In one or more embodiments, the blender transport 110 may function independently from the switch gear transport 112 and the power generation transport 102 and be powered by other means such as a diesel engine or a natural gas reciprocating engine. One or more pumps may pump source fluid and blender additives (e.g., sand) into a blending tub, mix the source fluid and blender additives together to form fracturing fluid, and discharge the fracturing fluid to the fracturing pump transports 108. In one embodiment, the electric blender may be a dual configuration blender that comprises electric motors for the rotating machinery that are located on a single transport. In another embodiment, a plurality of enclosed mixer hoppers may be used to supply the proppants and additives into a plurality of blending tubs.

The data van 114 may be part of a control system (e.g., a control network system), where the data van 114 acts as a control center configured to (e.g., remotely) monitor and provide operating instructions to remotely operate the evaporation system 101, the blender transport 110, the power generation transport 102, the fracturing pump transports 108, and/or other fracturing equipment within the mobile fracturing system 103. In one embodiment, the data van 114 may communicate with the variety of fracturing equipment using a control network system that has a ring topology (or star topology). A ring topology may reduce the amount of control cabling used for fracturing operations and increase the capacity and speed of data transfers and communication.

Other fracturing equipment shown in FIG. 1, such as fracturing liquid (e.g., water) tanks, chemical storage of chemical additives, hydration unit, sand conveyor, and sandbox storage are known by persons of ordinary skill in the art, and therefore are not discussed in further detail. In one or more embodiments of the mobile fracturing system 103, one or more of the other fracturing equipment shown in FIG. 1 may be configured to receive power generated from the power generation transport 102. The control network system for the mobile fracturing system 103 may remotely synchronize and/or slave the electric blender of the blender transport 110 with the electric motors of the fracturing pump transports 108.

Example Compartmentalized Fracturing Systems

Compartmentalized frac systems are frac systems (e.g., 103) with components organized into individual zones. A compartmentalized frac system may include components for isolating, bleeding, and/or priming each zone individually, thus enabling service work to be performed on a zone that is taken offline while other zones remain operational. This modular approach enhances the flexibility, control, and reliability of a frac system process.

Figure 2A:
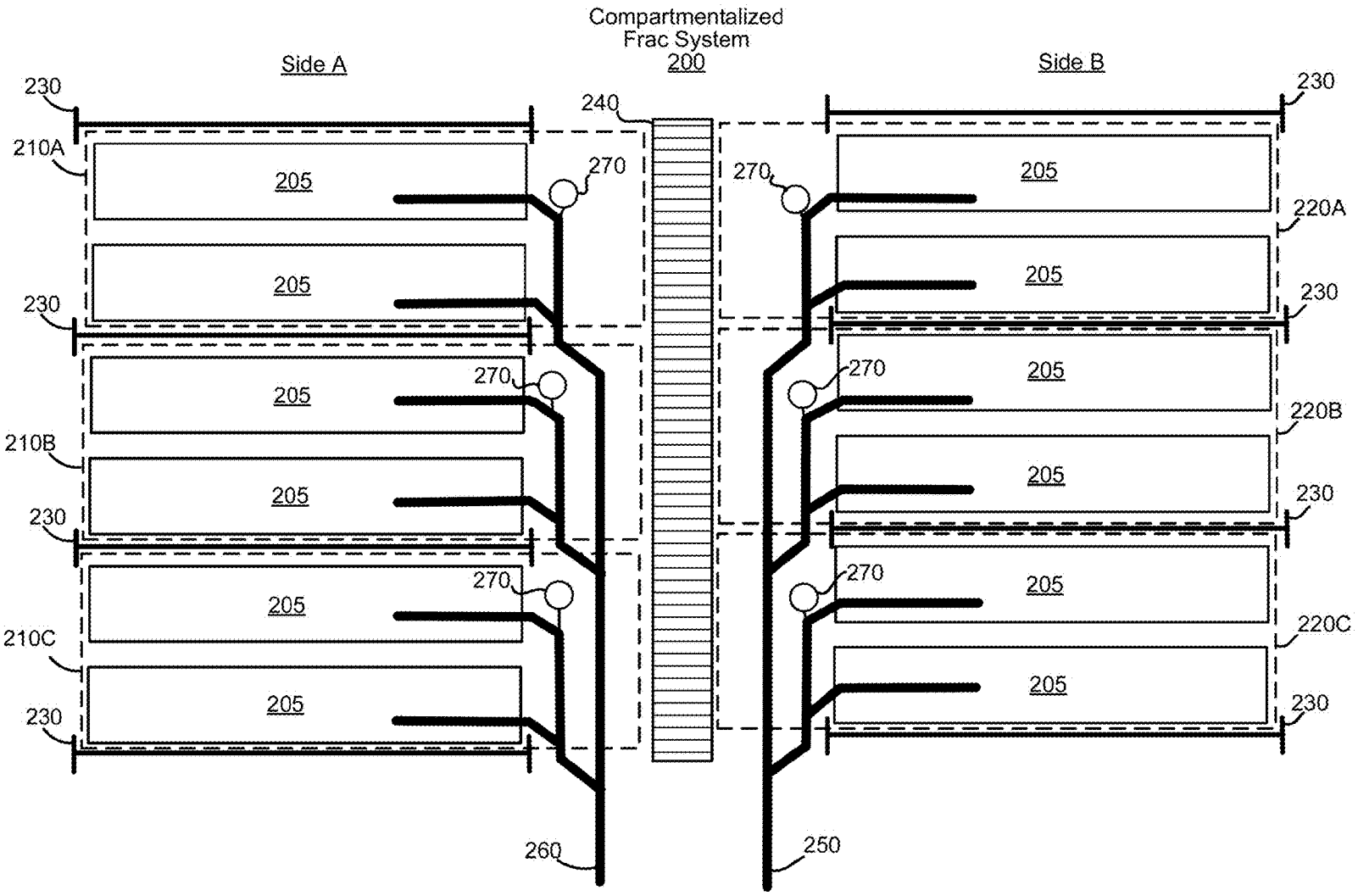
FIGS. 2A-2D are diagrams illustrating different views or components of a compartmentalized frac system, in accordance with one or more embodiments.
Figure 2B:
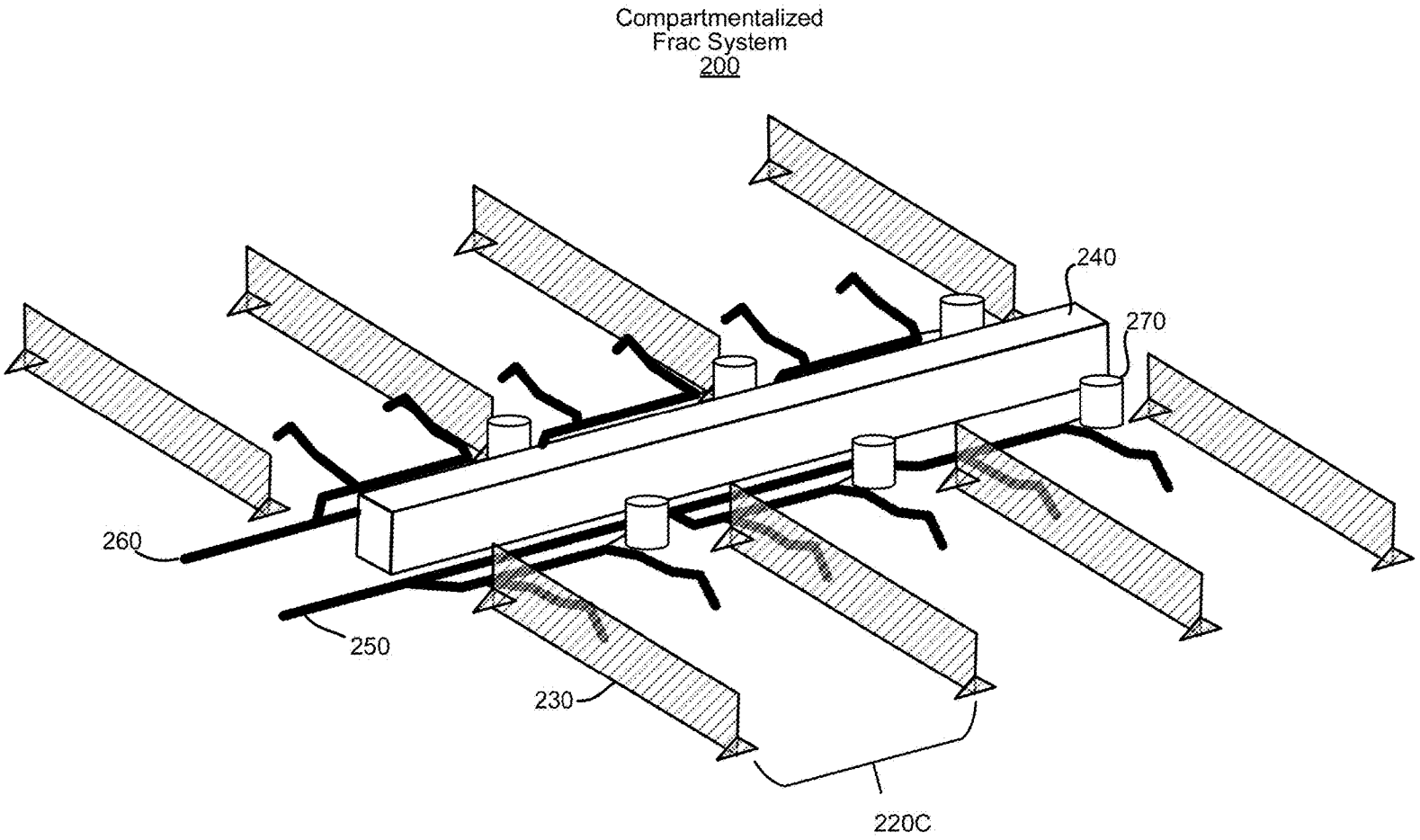
Figure 2C:
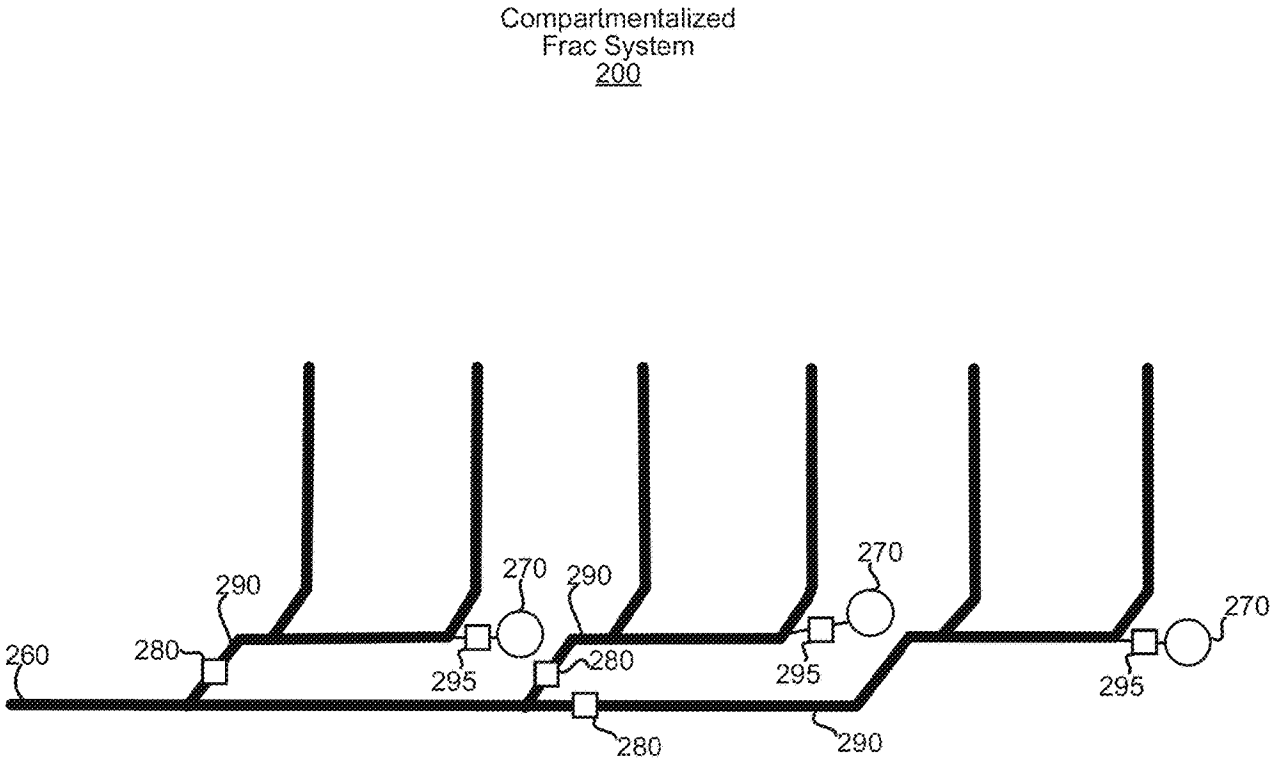
Figure 2D:
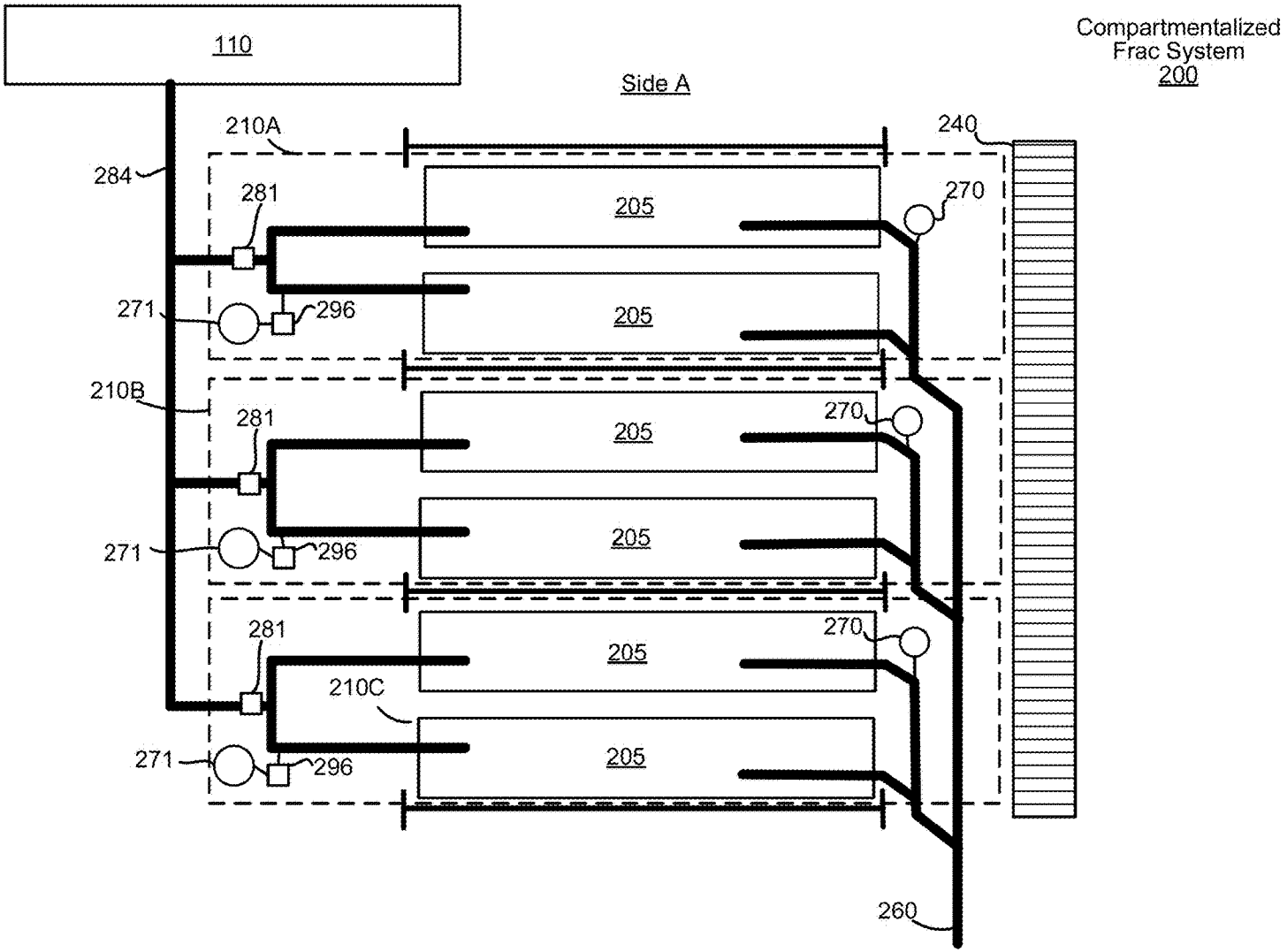

FIGS. 2A-2D ("FIG. 2" collectively) are diagrams illustrating different views or components of a compartmentalized frac system 200, according to one or more embodiments. FIG. 2A is a diagram illustrating an overhead plan view of the compartmentalized frac system 200. FIG. 2B is a diagram illustrating a perspective view of the compartmentalized frac system 200. Note that the frac pumps 205 are omitted from FIG. 2B for simplicity. FIG. 2C is a diagram illustrating a view of mono line 260 isolated from other components of the compartmentalized frac system 200. FIG. 2C also illustrates pressure control assembly 280, bleed assembly 295, and labels for segments of mono line 260, which are omitted from FIGS. 2A, 2B and 2C for simplicity. FIG. 2D is a diagram illustrating side A of the compartmentalized frac system 200 of FIG. 2A. FIG. 2D also includes a low-pressure line 284 for zones 210A-210C (low pressure lines are omitted from the FIGS. 2A-2C for simplicity). FIGS. 2A-2D are described together in the descriptions below. Note that reference labels as used herein may refer to a single component or to multiple components. For example, "205" can refer to a single frac pump (e.g., "frac pump 205") or multiple frac pumps (e.g., "frac pumps 205"). As another example, "205" can refer to a frac pump trailer that may include a single electric motor (or prime mover) that powers two frac pumps, one on either side of the electric motor. Any component on the frac pump trailer may require maintenance due to failure or service and the corresponding zone may be taken offline for the maintenance.

The compartmentalized frac system 200 includes a plurality of frac pumps 205 (these may be pumps of fracturing pump transports 108). The embodiment shown in FIG. 2 illustrates a simul-frac configuration where the compartmentalized frac system 200 is fracking two wells simultaneously, one with the mono line 260 and the other with the mono line 250, however a compartmentalized frac system can include any number of wells (one, three, four, etc.). The compartmentalized frac system 200 includes six zones 210A, 210B, 210C, 220A, 220B, and 220C, three on each side of partition wall 240. In this example, each zone includes two frac pumps 205 or two frac pump trailers (among other components as described later), however a zone can include one, three, or more frac pumps 205 or frac pump trailers. Frac pumps in zones 210A-C provide frac fluid into mono line 260, and frac pumps in zones 220A-C provide frac fluid into mono line 250. Each zone is separated from other zones by partition walls 230 and partition wall 240. Partition wall 240 is placed between the mono line 250 and mono line 260. This separates zones on the left side (Side A) from zones on the right side (Side B). Partition walls 230 separate zones on one side from other zones on the same side (e.g., a partition wall 230 separates zone 220A from zone 220B).

As previously stated, partition walls are positioned between zones 210A-C, 220A-C. A partition wall 230, 240 is a structure configured to prevent or reduce operations occurring in one zone from affecting operations in another (e.g., adjacent) zone. For example, a partition wall 230, 240 prevents or reduces a failure event in one zone from affecting operations in an adjacent zone (e.g., normal operations or service operations). In another example, if a first zone is deactivated, partition walls 230, 240 help allow service personnel to operate in the first zone (e.g., safely and/or without concern of a failure event in an adjacent zone) while an adjacent zone remains activated.

A partition wall 230, 240 may be one or more barriers, one or more walls, one or more containers, or any combination thereof (a partition wall may also referred to as a blast control barrier). For example, a partition wall 230, 240 is a transparent or translucent wall that has adequate blast resistance to meet predetermined safety criteria. As another example, a partition wall 230, 240 is a steel wall having appropriate dimensions and properties to meet the safety criteria. A partition wall may be a protective structure designed to mitigate the effects of explosions, pressure waves, and flying debris in high-risk environments such as industrial sites, oil and gas facilities, and military zones. These barriers can be constructed using reinforced materials like steel, composite panels, or energy-absorbing Kevlar fabric layers to withstand extreme forces. Their primary function is to shield personnel, equipment, and infrastructure by redirecting blast energy, reducing overpressure, and containing fragmentation. In some embodiments, the cross-section of a barrier includes a triangular (or "teepee") shape. The inclined angled side walls may help redirect projectiles or blast energy. Depending on the application, blast control barriers may be fixed or modular, allowing for flexible deployment and configuration to suit specific site requirements. For a compartmentalized frac system, modular blast control shields may be used that can be configured to isolate zones and protect personnel from the adjacent zones that are active. In hydraulic fracturing operations, blast control barriers help in missile and hose whip hazard protection by containing debris from high-pressure failures. When frac iron, frac hoses, or other pressurized components rupture or disconnect, they can release extreme force, sending heavy metal fragments and high-velocity projectiles across the site. Blast control barriers are strategically positioned to absorb impact energy and prevent these hazardous projectiles from reaching personnel and critical equipment. These barriers are engineered with reinforced structural elements, such as steel frames and/or ballistic-rated panels, to withstand the immense forces generated by high-pressure system failures, ensuring enhanced safety in frac site operations. These barriers may be strategically positioned so that personnel working on a piece of equipment in a deactivated zone have no direct line of sight (also "line of fire") to a pressurized piece of equipment in an adjacent active zone that is within a threshold distance (e.g., 35 feet). In some embodiments, a barrier height is taller than a human (e.g., 142 and ⅛ inches tall).

A mono line 250, 260 is a line that is used to transport frac fluid to a wellhead and into the wellbore. Frac pumps 205 of each zone can pump frac fluid into the corresponding segment of the mono line. A mono line includes segments 290 (labeled in FIG. 2C) coupled to the frac pumps or pump trailers of each zone (e.g., a different segment for each zone). A pressure control assembly (e.g., one or more isolation valves) 280 may couple a segment 290 or a zone to the rest of the mono line (e.g., 260). A pressure control assembly 280 is configured to control the flow of fluid between (a) one or more frac pumps 205 of a given zone and (b) the mono line (e.g., 260). Thus, the pressure control assembly 280 can isolate a segment 290 (and thus a zone (e.g., 210C)) from the rest of the mono line 260. The pressure control assembly 280 or the bleed assembly 295 can be remotely controlled (e.g., via actuators) by a control system. In some embodiments, each zone may include more than one pressure control assemblies (e.g., one pressure control assembly for each frac pump trailer of the zone, one pressure control assembly for each frac pump of each frac pump trailer of the zone, and the like). In some embodiments, each pressure control assembly may include double isolation valves on high pressure lines (to isolate the zone).

Each zone includes the segments 290 and the pressure control assemblies (e.g., gate valves, plug valves, flapper check valves) 280 to isolate the high-pressure mono line 250, 260 from the zone, and the bleed assemblies 295 to bleed off the high-pressure from the pumps in that zone into the bleed tank 270. As illustrated in FIG. 2D, each zone may further include one or more isolation valves (e.g., gate valves, plug valves) 281 at the low-pressure end (e.g., upstream end of the frac pump trailer or the frac pump in the zone) to isolate a zone from a low-pressure line 284 that feeds frac fluid into the one or more frac pumps or pump trailers of the zone.

FIG. 2C shows that a segment 290 of a high-pressure line 260 may be coupled to a bleed tank 270 (e.g., mounted to a skid) via a bleed assembly 295. Similarly, FIG. 2D shows that a segment of a low-pressure line 284 may be coupled to a bleed tank 271 via a bleed valve or assembly 296, however, in some embodiments, the low-pressure side of a zone (e.g., 210A) does not include a bleed tank 271 or a bleed valve 296. A bleed tank is a container designed to depressurize and store frac fluid from a high-pressure line and/or a low-pressure line (e.g., during maintenance or failure operations). Example bleed valves include gate valves, poppet valves, or plug valves. A bleed valve is configured to control the flow of fluid between the bleed tank and fluid in a segment of the zone (e.g., a bleed valve can release pressurized frac fluid into the bleed tank 270). Thus, one or more bleed tanks 270, 271 and bleed valves or assemblies 295, 296 can be used to depressurize a zone (e.g., after the corresponding isolation valves are closed and/or after the frac pumps are turned off). Note that an isolation valve or a bleed valve may be a double valve. In the example of FIG. 2, each zone (e.g., 210A) includes a bleed tank 271 and bleed valve 296 for the low-pressure side and a separate bleed tank 270 and pressure control assembly 295 for the high-pressure side. However, this is not required. For example, a bleed tank may be coupled to lines of two or more (e.g., adjacent) zones. In another example, a zone may include a single bleed tank coupled to both the high- and low-pressure sides.

As illustrated in FIG. 2D, each zone may include an isolation valve 281 at the low-pressure line 284 (for example, isolation valves to isolate low pressure fluid supply from the blender to the frac pumps and an isolation valve for each frac pump). The control system may be configured to coordinate operation of the low pressure isolation valve 281 and low pressure bleed valve 296 during zone reactivation, such that the bleed valve is closed, the isolation valve is opened, and the frac pumps are operated to prime the low pressure circuit before high pressure flow is resumed. Closing this valve 281 for a zone will allow low pressure frac fluid to be supplied to other zones, while stopping frac fluid from flowing into the zone. The low-pressure side may also include a bleed valve 296 to open the low-pressure side of the line to atmosphere and bleed off any fluid in the line to a bleed tank.

More generally, each zone of a compartmentalized frac system (e.g., 200) can include one or more bleed tanks 270, 271 to bleed off (also "depressurize") high-pressure and low-pressure lines of that zone (e.g., after the zone is isolated by actuating remotely the isolation valves for the high-pressure and low-pressure lines). By bleeding off the high-pressure and low-pressure lines via bleed tanks and bleed valves, and keeping the bleed valves open to atmosphere, a zone can be deactivated, thereby making it temporarily available (e.g., safe) for personnel to enter and perform the service operations on equipment in the deactivated zone. Deactivating a zone may also include disconnecting power to (e.g., turning off) one or more components in a zone (e.g., disconnecting power to a frac pump), as further described below.

In some embodiments, a zone (e.g., each zone) of a compartmentalized frac system 200 includes a pressure release valve (e.g., in parallel to a bleed valve 295) configured to release fluid (e.g., into the bleed tank 270) if pressure in the line exceeds a threshold pressure. A pressure release valve may be referred to as a relief valve.

Figure 7A:
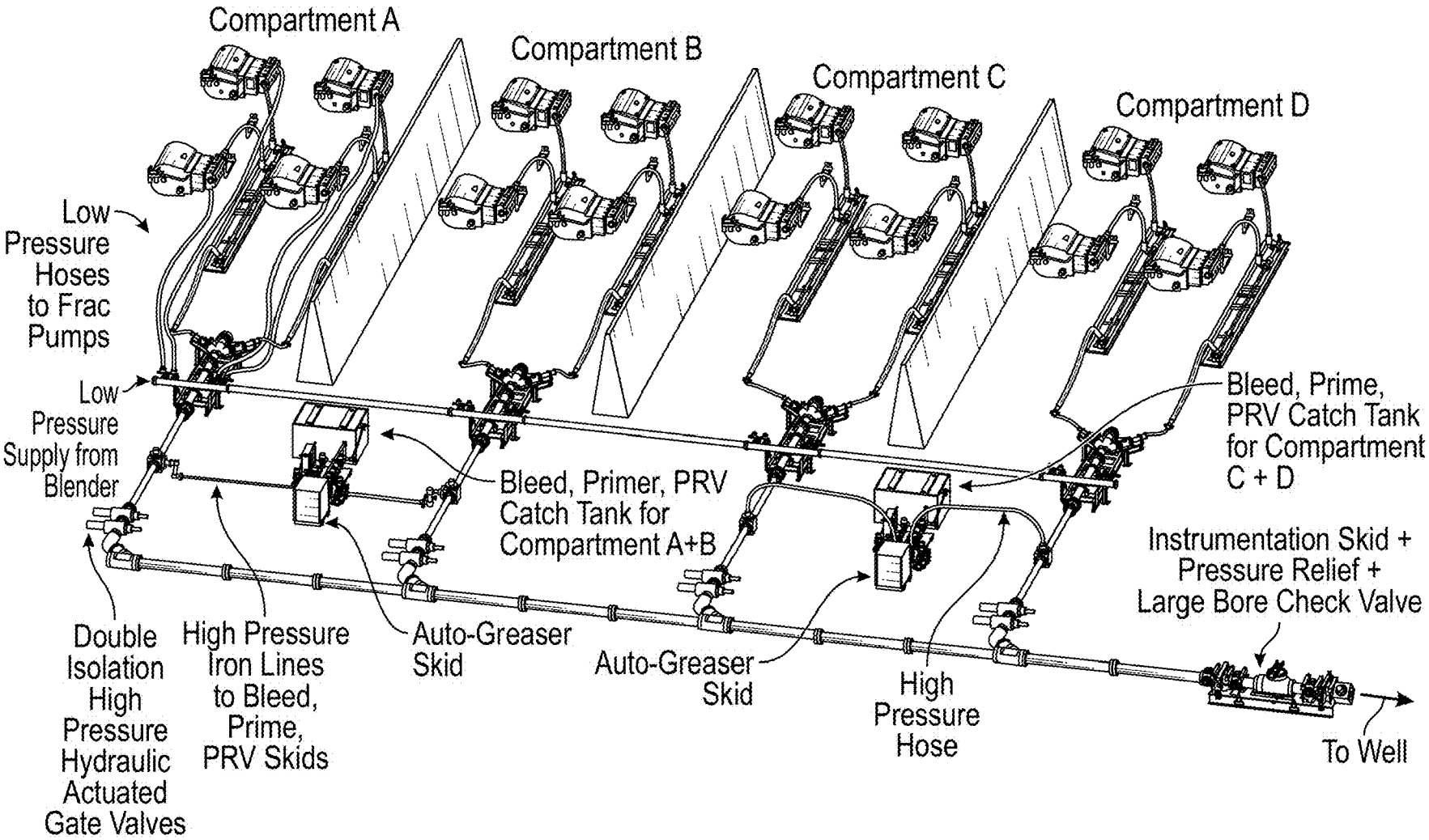
FIGS. 7A-7F are diagrams of another compartmentalized frac system, according to one or more embodiments.
Figure 7B:
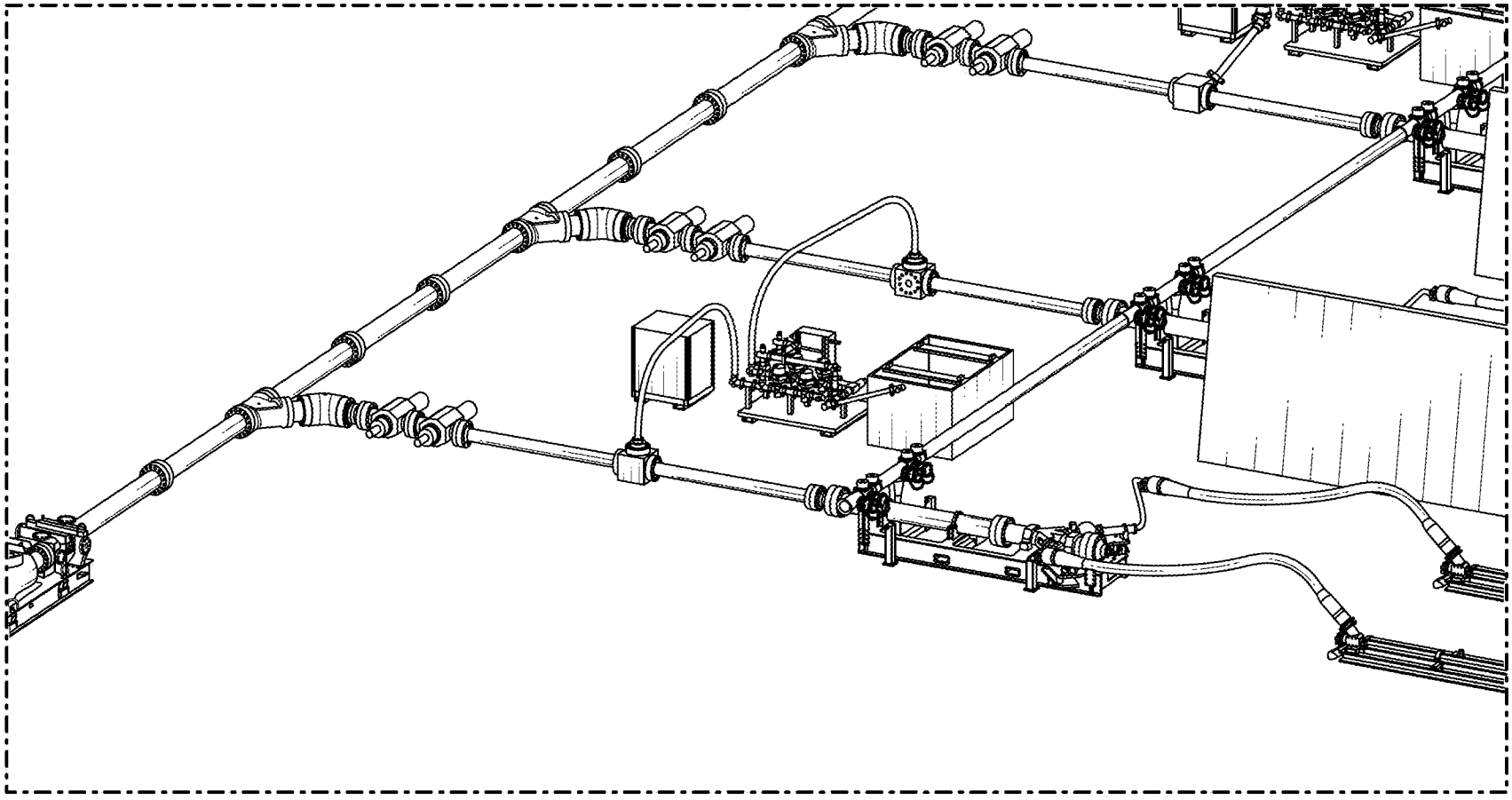

In some embodiments, a zone (e.g., each zone) of a compartmentalized frac system 200 includes a greater skid configured to deliver grease to relevant components (e.g., valves), thus reducing or eliminating manual greasing by humans and reducing maintenance time and personnel exposure to hazardous areas. Example greater skids are illustrated in FIGS. 7A and 7B.

As previously described, a frac system (e.g., 200) may include a switch gear trailer (e.g., 112) that provides power to the frac pumps 205 to power electric motors that drive the frac pumps (the switch gear trailer is not illustrated in FIG. 2). In one or more embodiments, the switch gear trailer may receive power at a relatively high-voltage level (e.g., 13.8 kilovolts) from a power generation trailer (e.g., 102) e.g., that includes a gas turbine and a generator for generating mobile electric power. The switch gear trailer may transmit the high-voltage level (e.g., 13.8 kilovolts) without performing a voltage step-down operation to downstream trailers such as the frac pumps 205, blender trailers (e.g., 110), and the like. The switch gear trailer may be connected to each frac pump or each frac pump trailer using a single cable connection. Each frac pump trailer may include one or more transformers to step down the voltage received from the switch gear trailer 112 to one or more lower voltage levels (e.g., 4.2 kilovolts, 600 volts, and the like) to provide power to different equipment (e.g., the electric motor, variable frequency drives, sensors, actuators, other equipment) of the frac pump trailer. To deenergize a zone (e.g., during deactivation), an entity (e.g., service personnel or a control system) may remotely turn off the power supply from the switch gear trailer (e.g., 112) to the one or more frac pumps of that particular zone. For example, the power may be turned off by manually operating levers provided on the switch gear trailer. As another example, the power may be turned off by remotely shutting off power supply from the data van or other location remote to the well site.

After completion of the desired service (e.g., maintenance or failure operations), a zone can be brought back online so the zone can resume contributing frac fluid to the corresponding mono line. Examples steps for reactivating a zone include priming the high-pressure and low-pressure lines, equalizing the pressure with the corresponding mono line (e.g., 250 or 260), and opening the isolation valve for that zone to restart sending fluid downhole from the selected zone.

As previously stated, a frac system (e.g., 200) may include a control system (e.g., implemented in whole or in part via data van 114). The control system may (e.g., remotely) control deactivation and reactivation of a zone in a compartmentalized frac system (e.g., 200). The control system may manage the flow rate or pressure that is being pumped downhole while one or more zones are selectively taken offline and brought back online. For example, the control system may automatically ramp up flow rates or pressures from other zones when a particular zone is deactivated and then ramp down the flow rates or pressures from the other zones as the particular zone is brought back online, so as to maintain target flow rates or pressures (e.g., per contractual agreements).

The control system may be configured to utilize sensors and actuators to automate the zone deactivation or reactivation processes. For example, based on a user instruction or a predetermined service condition being satisfied (e.g., a maintenance schedule indicates service should be performed on a zone, a detected failure condition (e.g., determined based on sensor data or a user indication) is determined in a zone), the control system automatically actuates components to deactivate a zone. This may include shutting off power to the zone, isolating the zone from the high-pressure mono line, isolating the zone from the low-pressure mono line, bleeding off the high-pressure and the low-pressure fluids in the zone to a bleed tank, and keeping the high-pressure and the low-pressure lines of the zone open to atmosphere. The control system may utilize sensors to detect when the zone is deactivated (e.g., and thus safe for personnel to enter) and issue a notification (e.g., via a user interface) indicating the same.

The control system may take steps to automatically reactivate the zone (e.g., after the service work is completed and the zone is ready for reactivation). The control system may reactivate a zone after receiving a reactivation instruction (e.g., from a user) or based on sensor data indicating that a service condition (e.g., a failure condition) has been resolved. To reactivate a zone, the control system may restart the power supply from the switch gear to the one or more frac pumps included in the zone and operates the electric motors to begin driving the frac pumps in the zone to prime the high-pressure or low-pressure fluid lines in the zone. To prime a line of a zone (e.g., to prime a segment of a mono line), the low-pressure bleed valve is closed (if the zone includes a low-pressure bleed valve) and the low-pressure isolation valve is opened to let the frac fluid into the zone, and the one or more frac pumps of that zone may be operated while keeping the high-pressure bleed valve open so that air in the line is removed (while the high-pressure isolation valve remains closed). This priming operation may be performed until the control system determines the line is primed. For example, the line is primed for a threshold amount of time (e.g., for approximately one minute while the pump(s) move fluid at a threshold rate (e.g., five bbl/min)), a user confirmation is received, the control system determines air in the line is below a target threshold (e.g., based on sensor data), or some combination thereof.

After the line is primed, the control system closes the bleed valve(s) (e.g., the high-pressure bleed valve). The control system may then continue to operate the frac pumps while the high-pressure isolation valve of the pressure control assembly remains closed to increase the pressure in the high-pressure line to equalize the pressure with that in the mono line 250, 260 (e.g., six thousand pounds per square inch). The control system may determine pressure equalization has occurred based on data generated by one or more pressure sensors. The control system may then open the isolation valve (e.g., by controlling an actuator) and begin sending fluid downhole from the zone.

After the line is primed, the (e.g., high-pressure) bleed valve is closed, and the isolation valve remains closed, in some embodiments the control system performs a pressure test by operating the pumps to increase the pressure in the line to be above the pressure in the mono line 250, 260 (the pressure in the mono line may be referred to as the "equalization pressure"). The pressure in the line may be increased to a target pressure (e.g., nine thousand pounds per square inch) that is significantly higher than the pressure in the mono line (e.g., 10% or 1,500 PSI above the pressure in the mono line) but below a threshold pressure of a pressure release valve of the high-pressure mono line. For example, if service was performed on the zone, increasing the pressure to the target pressure helps confirm that the zone was serviced properly and components in the zone are functioning as intended (e.g., they were installed or repaired correctly). The pressure test may also help identify any potential leaks in the line. After the target high pressure is reached (e.g., and the zone is confirmed to be operating as desired), the control system may control the zone to equalize the pressure in the line with the pressure in the mono line. In one example, the control system (e.g., slowly) reduces the pressure in the line until the pressure lowers to the equalization pressure (e.g., by actively controlling the bleed valve and the frac pumps). In another example, the control system opens the (e.g., high-pressure) bleed valve to release the pressure in the line. The control system may then close the (e.g., high-pressure) bleed valve and operate the pumps to bring the pressure up to the equalization pressure. In some embodiments, the pressure equalization step may not be required depending on the configuration of the pressure control assembly implemented in the zone.

The following paragraphs describe setting up a compartmentalized frac system and steps a control system may take to deactivate and later reactivate a zone of a compartmentalized frac system. Among other advantages, deactivating a zone may temporarily create a safe zone without having to move equipment around or out of the red zone.

To set up a compartmentalized frac system, an operator may determine the number of zones and the number of frac pumps to be included in each zone based on, for example, customer requirements for downhole pressure and rate, site layout, equipment availability, and equipment specifications. The compartmentalized frac system, including the isolation valves, the bleed and prime skids, the partition walls, power supply connections, and the like (e.g., the relief system), may be set up based on the determined design.

During fracking, when a service event is detected (e.g., a scheduled or unexpected maintenance or failure event), the control system may detect which zone is affected and take steps to deactivate the zone while also ramping up the production from the other zones to compensate for the loss of rate (or pressure) from the zone being deactivated.

Firstly, the control system may ramp down the frac pumps of the zone (e.g., to zero RPM (revolutions per minute). For example, the frac pumps are instructed to stop stroking. In some embodiments, the control system turns off the power to the frac pumps in the identified zone. For example, the control system may operate an actuator that remotely switches off the power supply from the switch gear trailer to the one or more frac pumps in the affected zone. Disconnecting the power from frac pumps may decrease the likelihood of the frac pumps (e.g., unintentionally) operating during service work. Other components in a zone may be deenergized as well (e.g., turned off or disconnected from a power source) during the deactivation process.

The control system may isolate the high-pressure fluid flowing into the mono line from the affected zone by closing a first isolation valve for that zone (this valve may be referred to as a "high-pressure isolation valve"). The control system may also isolate the low-pressure frac fluid from flowing into the pumps in the affected zone by closing a second isolation valve (or multiple redundant isolation valves) for that zone (this valve may be referred to as a "low-pressure isolation valve"). For example, the isolation valves are plug valves, butterfly valves, or gate valves and they are actuated remotely to isolate the high-pressure and low-pressure lines for the affected zone. In some embodiments, any isolation valve of a zone may be interlocked with the frac pumps of that zone such that the valves cannot be closed until the pumps are safely ramped down (e.g., to zero RPM).

Next, the control system may open a high-pressure bleed valve of the affected zone to bleed off the high-pressure fluid downstream of the frac pumps to one or more bleed tanks. The high pressure frac fluid may bleed off through a remotely controlled, adjustable or fixed choke. The choke may have carbide seat or hardened steel interior components for wear resistance. The control system may also open a low-pressure bleed valve of the affected zone to bleed off the low-pressure fluid upstream of the frac pumps in the zone into the one or more bleed tanks. The control system may utilize a sensor (e.g., a flow rate sensor or pressure sensor) to confirm the affected zone is deactivated after the high-pressure and low-pressure lines of the affected zone have been bled off. The control system may also utilize sensors to confirm the high-pressure and low-pressure lines in the zone are open to atmosphere.

Based on a determination that the zone is deactivated, the control system may provide a notification to an operator (e.g., via a user interface) that the zone is deactivated (e.g., this may further state that the zone is safe for human entry). After completion of the service work, an operator may notify the control system that the zone is now ready to be reactivated.

Subsequent (e.g., responsive) to the notification, the control system may restart power to the zone (e.g., by connecting the frac pumps to the switch gear trailer) and/or increasing the RPM of the frac pumps in the zone. The control system may prime the high-pressure and low-pressure lines while keeping the bleed valves open. Frac fluid may be introduced to the frac pumps in the zone from the blender trailer by opening the isolation valve for the low-pressure lines to prime the frac pumps and the high-pressure lines. After detecting the lines have been sufficiently primed (e.g., based on sensor data), the control system closes the bleed valves. The control system may ramp up the pressure on the high-pressure lines until the pressure has equalized with the high-pressure on the mono line feeding the frac fluid downhole. After equalizing the pressure, the control system may actuate the isolation valve on the high-pressure line to begin sending fluid downhole. As previously described, the control system may, additionally or alternatively, perform a pressure test prior to opening the high-pressure isolation valves.

Thus, a compartmentalized frac system 200 may enable a zone to be deactivated without disconnecting electrical connections, without disconnecting high-pressure or low-pressure fluid connections, without moving pump trailers out of their designated spot during operation, or any combination thereof. As a result, service operation time can be reduced, and the zone can be reactivated relatively quickly after completion of the service work.

Although some of the descriptions herein refer to the control system performing operations automatically, this is not required. Any combination of operations performed by a control system described herein may be performed subsequent (e.g., responsive) to receiving a user instruction, semi-automatically (e.g., the control system begins performing a first operation automatically but waits for a user instruction (e.g., confirmation) before (a) completing the first operation or (b) performing a second subsequent operation), fully automatically, or some combination thereof. In some embodiments, the type of service event for a zone affects the level of automation by the control system. For example, if the service event is a routine and scheduled event for a zone, the control system may wait for a user instruction before performing one or more operations of a deactivation process for that zone. However, if the control system detects (based on sensor data) an event in a zone that requires quick or immediate service (e.g., a sudden loss in pressure signaling a leak in a line), the control system may automatically perform one or more operations of a deactivation process.

As used herein, a service condition (also "service event") for a zone may refer to a condition (e.g., a circumstance or event) that, after the condition is met, indicates the zone should be deactivated to allow service to be performed on that zone. Example service conditions may include a maintenance schedule, a user indication, or a failure event (e.g., detected by the control system based on sensor data) indicating service should be performed. As used herein, a reactivation condition for a zone may refer to a condition that, after the condition is met, indicates the zone can be reactivated. An example reactivation condition is a user indication indicating service of the zone is complete.

Figure 3:
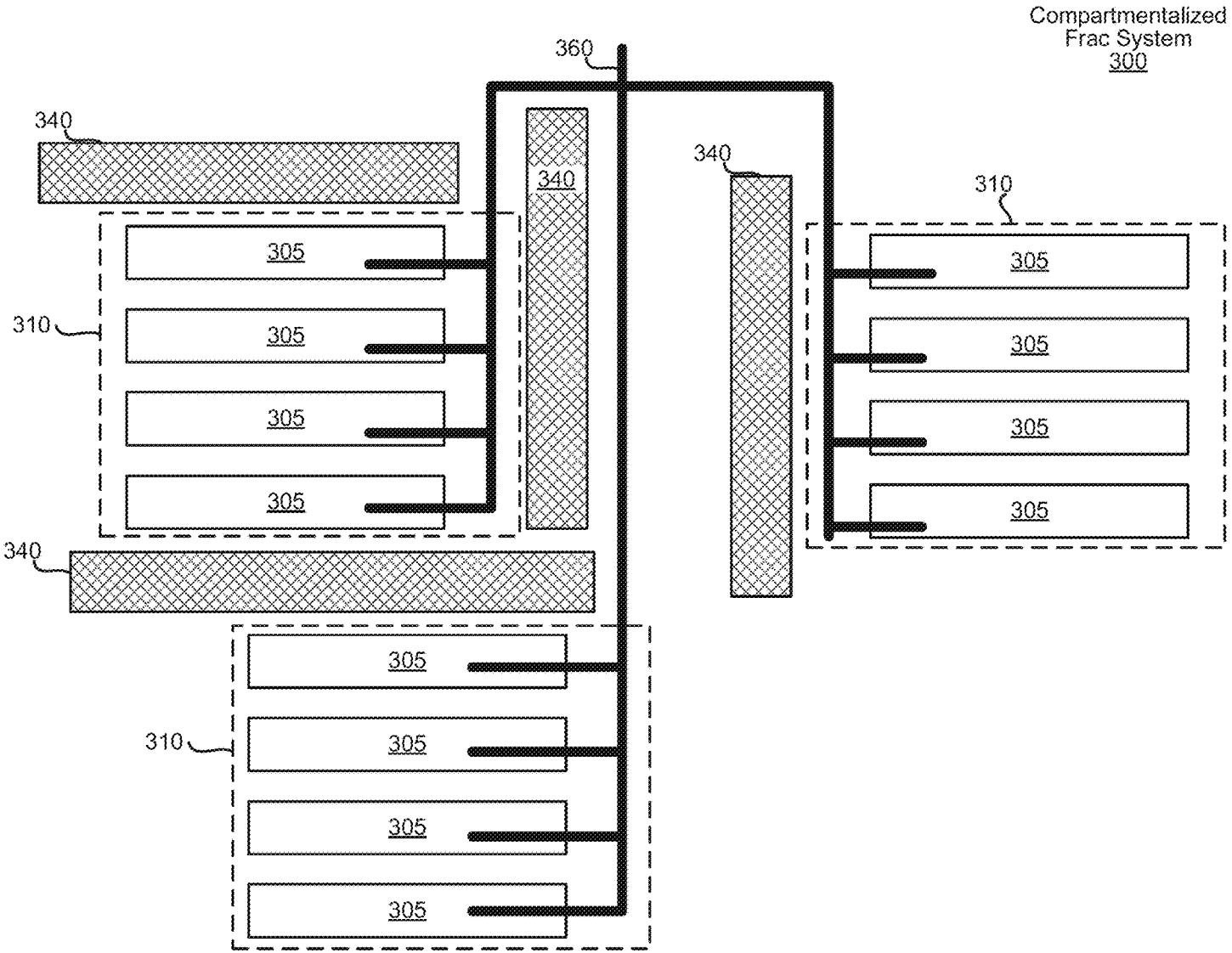
FIG. 3 is a diagram of another compartmentalized frac system that includes three zones, in accordance with one or more embodiments.

FIG. 3 is a diagram of another compartmentalized frac system 300 that includes three zones 310, according to one or more embodiments. Each zone 310 includes four frac pumps trailers 305 (e.g., each trailer 305 may include one or more frac pumps), and all zones 310 connect to a single mono line 360 sending high-pressure frac fluid into a wellbore. Multiple partition walls 340 separate the zones 310. Note that the low-pressure side of FIG. 3 is omitted for simplicity. Although not illustrated, one or more blender transports provide low-pressure frac fluid to each frac pump trailer 305 of each zone 310.

FIGS. 7A-7F ("FIG. 7" collectively) are diagrams of another compartmentalized frac system, according to one or more embodiments. FIG. 7A is a first perspective view of the compartmentalized frac system. FIG. 7B is a second perspective view of the compartmentalized frac system. The compartmentalized frac system includes four zones (referred to as compartments A-D). The compartmentalized frac system includes a low-pressure supply line from a blender (e.g., 110) that carries low-pressure fluid across all four compartments. Via a pump station pod (e.g., see FIG. 7E) and low-pressure hoses, the low-pressure fluid is provided from the low-pressure supply line to individual frac pumps. For ease of illustration, the low-pressure hoses are only illustrated for compartment A. Double isolation high pressure hydraulic actuated gate valves connect the high-pressure line of each compartment to the mono line (which leads to a well). The mono line includes an instrumentation skid, a pressure relieve valve, and a bore check valve. Compartments A and B are both coupled to a bleed skid that includes bleed valves, pressure relieve valves (PRVs), and a bleed tank (note that the bleed tank may be on a separate skid). Compartments A and B are coupled to the bleed skid via high-pressure iron lines. The bleed skid is further described with respect to FIGS. 7C-7D. Compartments A and B are also coupled to an auto-greaser skid. Compartments C and D are similarly coupled to a second bleed skid and a second auto-greaser skid. Compartments C and D are coupled to the second bleed skid via high pressure hoses.

Figure 7C:
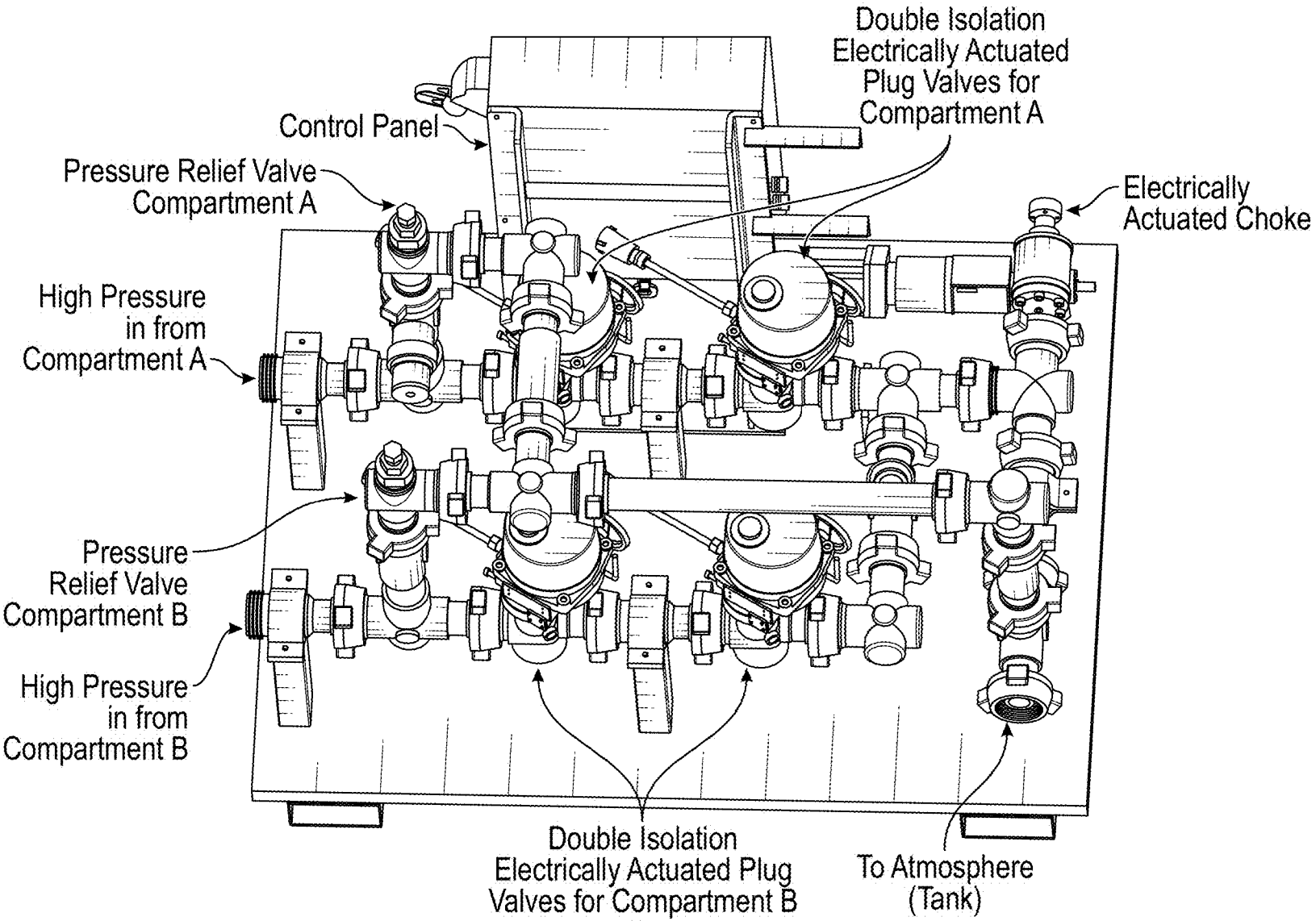
Figure 7D:
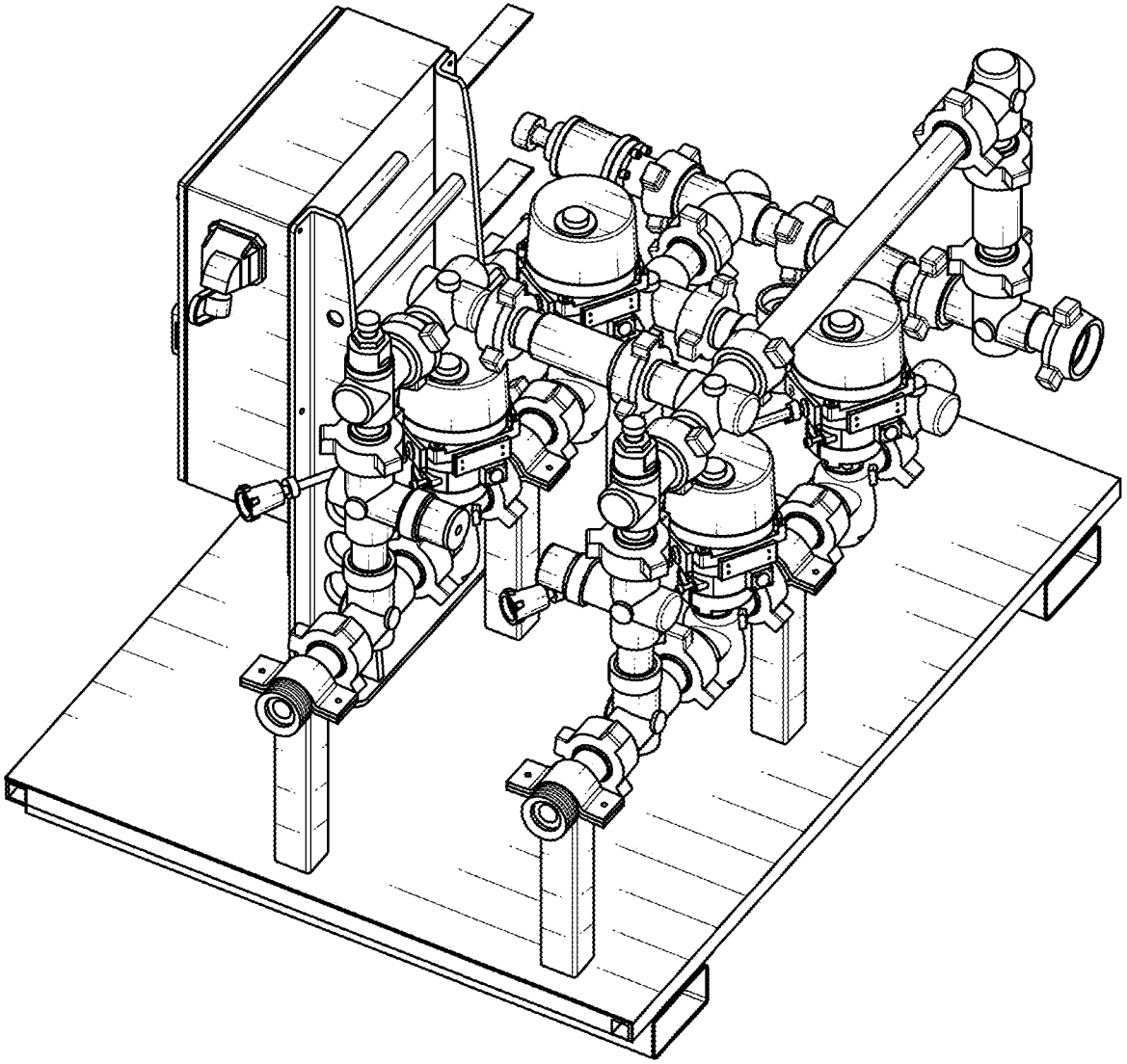

FIG. 7C is a first perspective view of the bleed skid coupled to compartments A and B. FIG. 7D is a second perspective view of the bleed skid. In this example, the bleed skid includes a control panel, a first line that receives high-pressure fluid from compartment A, a second line that receives high-pressure fluid from compartment B, and a third line that can carry fluid to a (bleed) tank that is open to atmosphere (the tank is not illustrated). The first line includes a pressure relieve valve and double isolation electrically actuated plug valves for compartment A (these are bleed valves). The second line includes a pressure relieve valve and double isolation electrically actuated plug valves for compartment B (these are bleed valves). The first and second lines are connected to the third line, and the bleed valves control the flow of fluid in each line to the third line. Output from both relief valves is also directed to the third line. The third line also includes an electrically actuated choke.

Figure 7E:
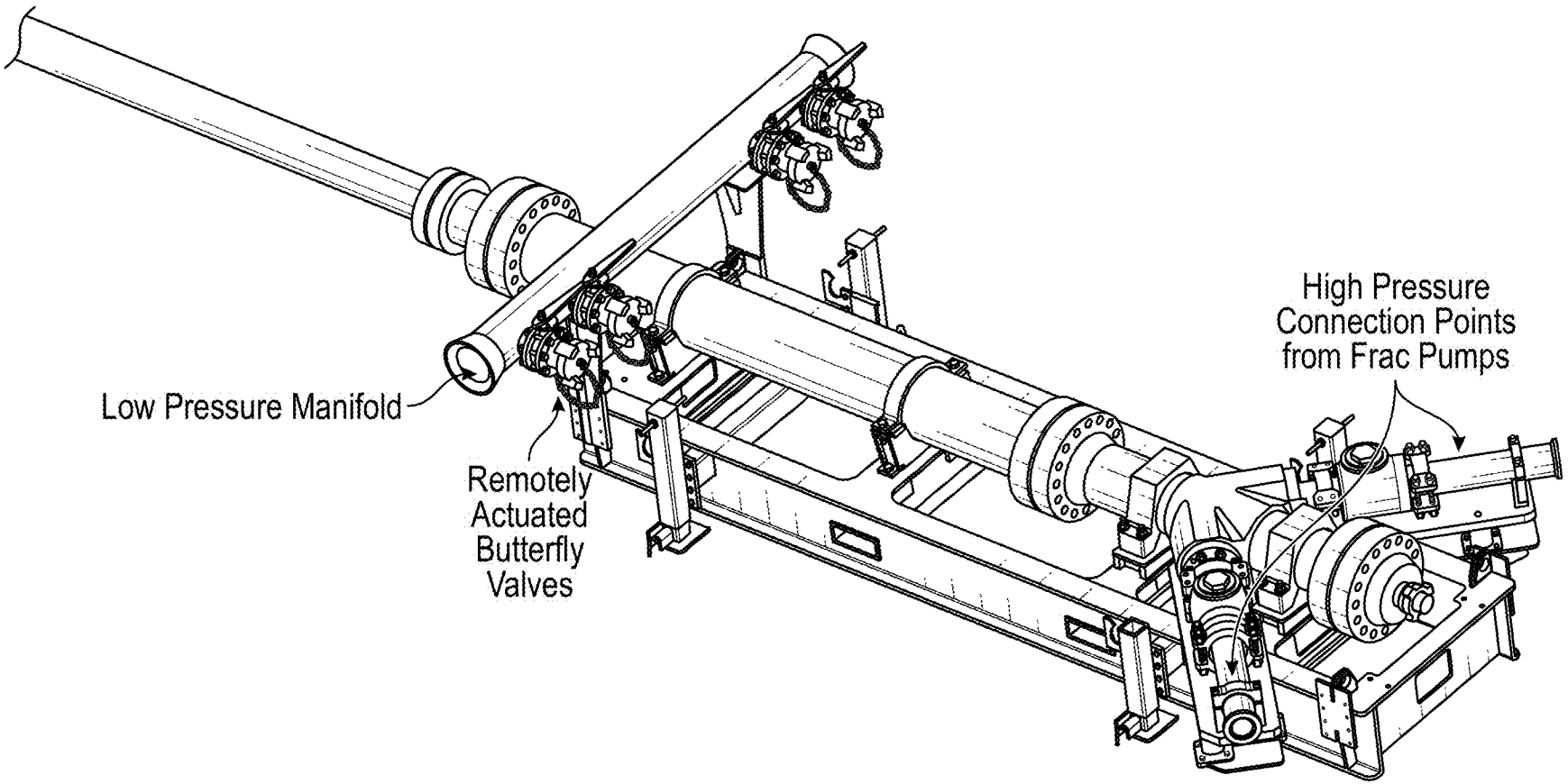
Figure 7F:
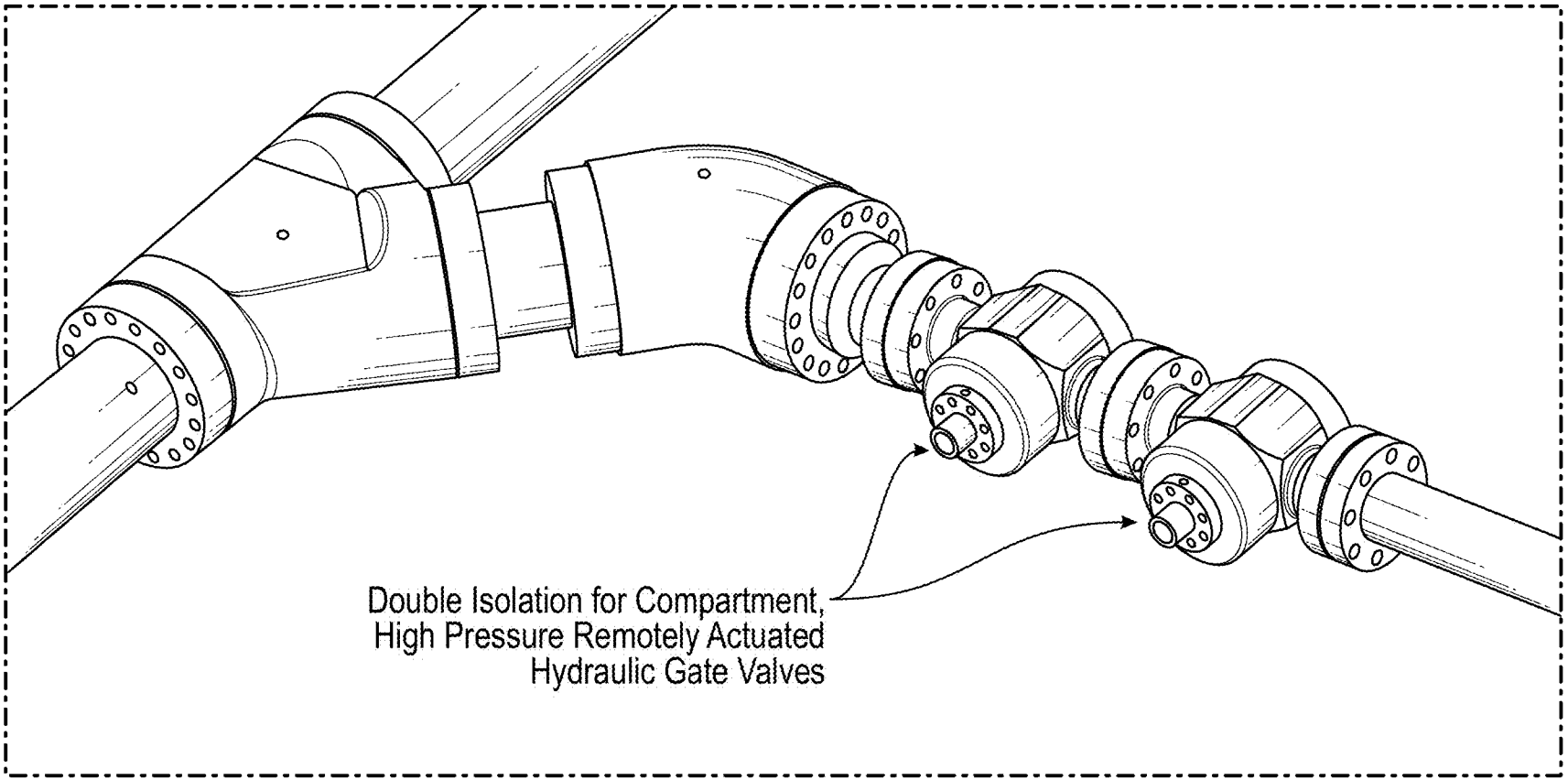

FIG. 7E is a perspective view of a pump station pod. The pump station pod includes high pressure connection points to receive fluid from different frac pumps. The pump station pod also includes a low-pressure manifold (this is part of the low-pressure supply line in FIGS. 7A-7B) and remotely actuated butterfly valves (these connect to the frac pumps via low-pressure hoses). FIG. 7F is a perspective view of a double isolation valve on one of the high-pressure lines of a compartment. In this example, the double isolation valve includes two high-pressure remotely actuated hydraulic gate valves.

Example Pressure Control Assembly with Dual Gate Valves

Figure 8A:
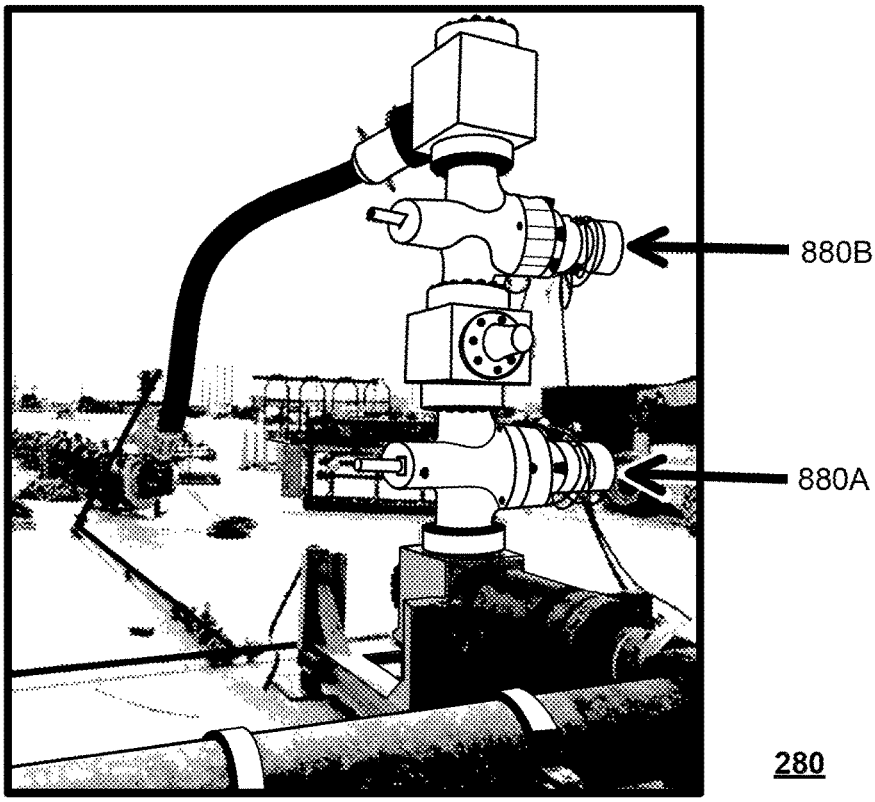
FIGS. 8A-8B are diagrams of a pressure control assembly, according to one or more embodiments.
Figure 8B:
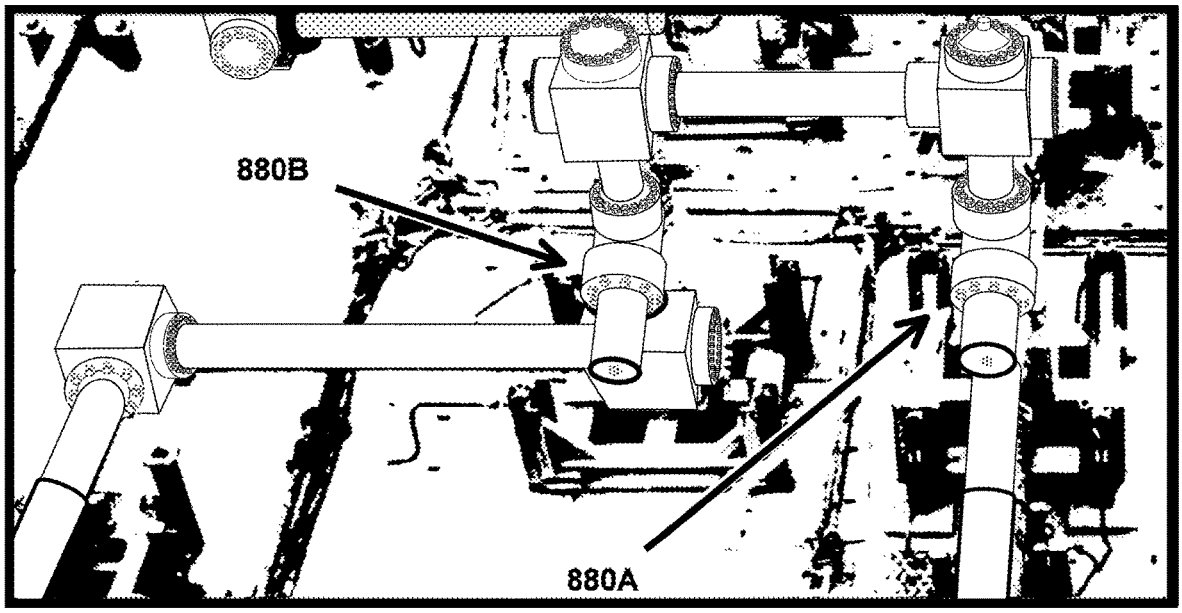

FIGS. 8A and 8B illustrate embodiments of a pressure control assembly 280 positioned between a zone of a compartmentalized hydraulic fracturing system and the corresponding mono line. Each pressure control assembly 280 may provide high pressure isolation between a set of one or more frac pumps in a zone and the main line conveying frac fluid toward the wellhead. In the embodiments shown, the assembly 280 includes two hydraulically actuated gate valves 880A, 880B arranged in series to establish primary and secondary pressure barriers for each compartment. The valves 880 are configured for high pressure service, for example 15,000 psi working pressure, and may be of the slab-gate type with hydraulic actuators, position indicators, and high pressure flanged or clamp-hub connections suitable for rapid field replacement.

In the configuration of FIG. 8A, the two gate valves 880 are arranged in a vertical stack orientation. This configuration may provide a compact footprint while maintaining direct axial alignment of the flow path. Hydraulic actuators may be mounted above each valve body and may be controlled remotely by a hydraulic valve control panel located outside the red zone area. In the configuration of FIG. 8B, the two gate valves 880 are arranged in a bridge orientation, where the valve bodies are mounted laterally adjacent with interconnecting high pressure crossover piping. The bridge arrangement may allow improved service access and can simplify routing of hydraulic actuation lines. In either orientation, the upstream valve 880B may be positioned on the pump-side of the assembly and the downstream valve 880A may be positioned on the mono line-side, together providing double isolation between the high pressure pumping equipment and the main flow line.

Each valve 880 may include mechanical or visual position indicators to confirm open or closed status from a remote location. The actuators may be operated by hydraulic fluid supplied from accumulators and controlled through manual or automated control valves at the hydraulic control panel.

The dual valve configuration may provide redundant containment of high pressure frac fluid and define a confined intermediate cavity that can be vented, monitored, or bled down as part of a controlled isolation process. This arrangement ensures that personnel working within an isolated compartment are protected from the high pressure fluid that continues to move downhole through the mono line and adjacent zones.

To safely depressurize a compartment equipped with the dual gate valve pressure control assembly of FIGS. 8A-8B, one or more bleed assemblies 295 may be provided per zone. In one embodiment, the bleed assembly 295 may include a bleed-air-transducer (BAT) system to provide a staged pressure relief path through a choke line and a bypass line to a bleed tank open to atmosphere. The BAT system may include a first valve that directs high-pressure flow through a restricted choke to gradually reduce pressure and a second valve that opens a larger "gut line" or bypass path for rapid venting once pressure has dropped below a threshold level (e.g., below 100 psi). In another embodiment, the bleed assembly 295 may include a wrap around bleed off system. The wrap around configuration may include a set of plug valves arranged such that opening the inside (or mono line-side), outside (or zone-side), and bypass plug valves may form a continuous path from the pump-side of the assembly, and to a bleed tank through a choke. In some configurations, the wrap-around bleed assembly 295 may include a first plug valve on the pump-side connection, a second plug valve in series and downstream of the first plug valve leading toward the choke and bleed tank, and a third plug valve forming a bypass line that circumvents the choke to enable rapid depressurization. Both bleed assembly 295 embodiments or configurations may allow trapped pressure to be relieved in a controlled manner without disconnecting high-pressure iron or moving pump trailers.

During a zone isolation sequence, the pump operator may gradually reduce flow from the pumps of the selected zone and confirm zero output. Using the remote hydraulic control panel, the operator may close the mono-line-side gate valve 880A first to isolate the zone from the active mono line. The high pressure in the zone may then be vented through the BAT or wrap-around bleed assembly 295 until the pressure within the isolated zone has fallen to near-atmospheric levels. Once depressurized, the pump-side gate valve 880B may be closed to establish double isolation. The low-pressure feed to the pumps may also be shut off, and all bleed valves verified to be open to atmosphere. After both gate valves 880A, 880B are confirmed closed and the segment of the zone is at zero pressure, the compartment may be deemed isolated and safe for maintenance or inspection activities.

After maintenance is complete, the reactivation sequence may begin with priming the high-pressure and low-pressure lines, closing the bleed assembly 295 valves and gradual re-pressurization of the isolated leg. The pump-side gate valve 880B may be opened first, allowing the pumps to charge the high-pressure segment with clean fluid. Pressure may then be carefully increased and monitored (e.g., using pressure sensors provided at one or more locations on the line) until the pump-side pressure approximately equals the mono line pressure. When near-equalization is achieved, the mono line-side gate valve 880A may be opened to restore full communication with the mono line, and pumping operations resume. Because hydraulic gate valves are not designed for throttling or opening under large differential pressure, this equalization step may be performed slowly to minimize the risk of erosion or wire-drawing at the valve seats. The use of two valves 880A, 880B may allow one to remain closed while the other is operated under low differential pressure, maintaining a redundant barrier to high-pressure fluid at all times.

The dual-gate valve configuration of FIGS. 8A and 8B may thus provides robust high pressure containment for each zone and for the compartmentalized isolation process. Each assembly 280 serves both as a controllable flow path during normal operation and as a redundant isolation barrier during maintenance, ensuring that pressure and flow from active zones remain confined while adjacent zones are safely deactivated. Subsequent embodiments described in connection with FIGS. 9A and 9B illustrate additional variations of the pressure control assembly 280 employing components or arrangements to simplify the isolation procedure and reduce operational complexity.

Example Pressure Control Assembly with One-Way Isolation Valve

Figure 9A:
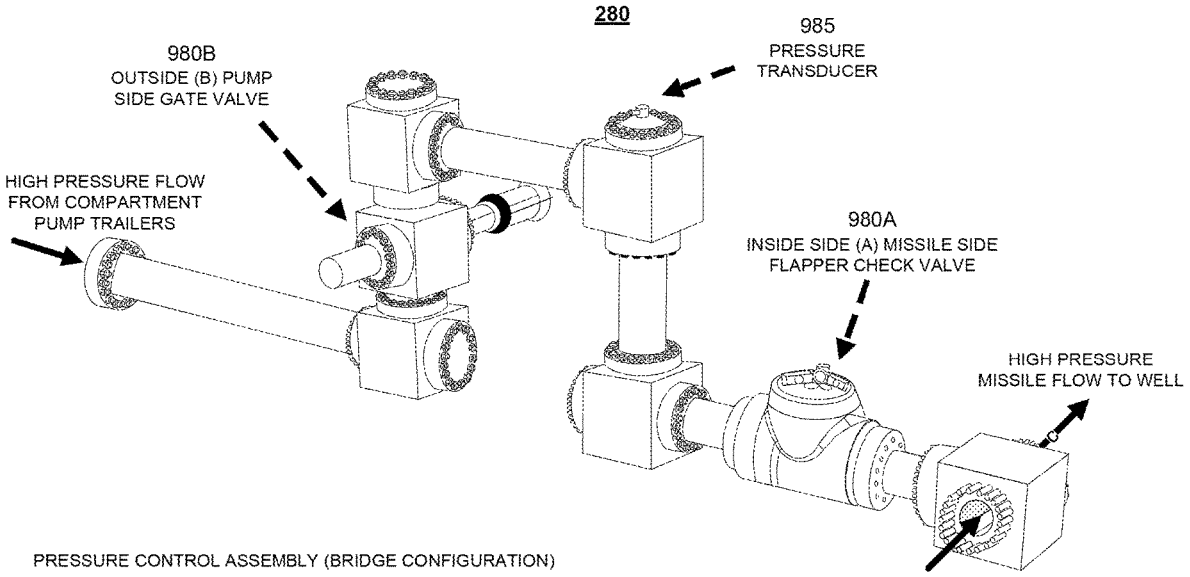
FIGS. 9A-9B are diagrams of another pressure control assembly, according to one or more embodiments.
Figure 9B:
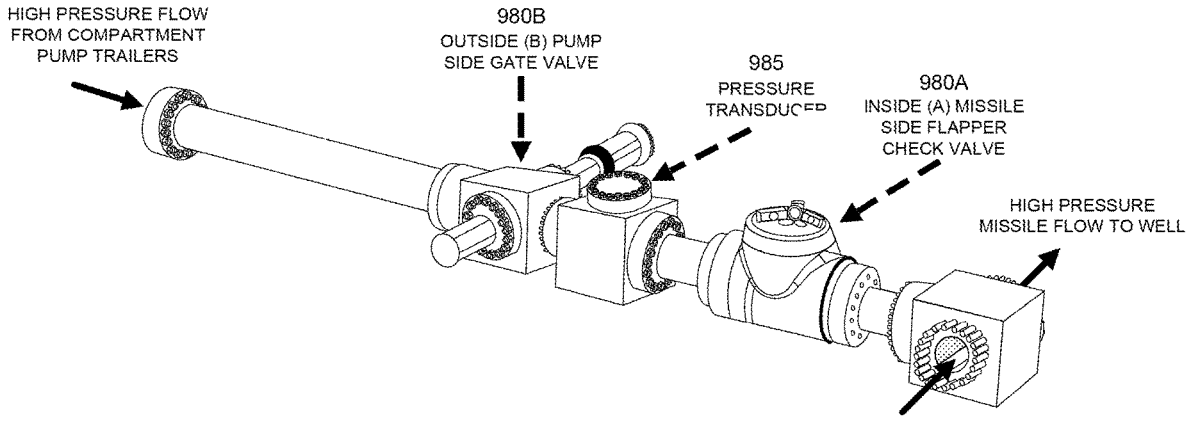

FIGS. 9A and 9B illustrate embodiments of a pressure control assembly 280 that may be positioned between a set of one or more frac pumps in a zone of a compartmentalized hydraulic fracturing system and a mono line configured to carry high pressure frac fluid into a well. The pressure control assembly 280 may be fluidly coupled in series between the pump discharge of a given zone and the mono line and provide both active and passive pressure isolation capability. In some embodiments, the pressure control assembly may include an isolation valve 980B (e.g., second isolation valve), which may be a hydraulically actuated gate valve positioned on the pump-side of the assembly 280, and an isolation valve 980A (e.g., first isolation valve), which may be a passive one-way valve positioned between the gate valve 980B and the mono line. The first isolation valve 980A may take the form of a flapper-type check valve, swing check valve, disc check valve, or other valve construction that can achieve similar one-way, differential-pressure-responsive operation. A pressure transducer 985 may be disposed on the conduit segment between the first and second isolation valves 980 to monitor the pressure upstream of the check valve 980A and provide real-time feedback to the control system during activation, bleed-down, or re-pressurization events.

The pressure control assembly 280 may be implemented in different physical arrangements depending on system layout. In the bridge configuration shown in FIG. 9A, the mono line-side passive valve 980A and the pump-side gate valve 980B are mounted in series and laterally adjacent with interconnecting high-pressure crossover piping. This orientation facilitates compact mounting within a skid or manifold frame and allows independent servicing or replacement of either valve. In the horizontal configuration shown in FIG. 9B, the valves 980A and 980B are arranged along a straight axis, providing a direct flow path from the pump or zone outlet to the mono line. In either arrangement, the assembly 280 defines an isolation assembly so that a selected zone can be vented, monitored, or bled down via a bleed valve or assembly 295 coupled to that zone.

During operation, the second isolation valve 980B may function as an actively controlled barrier separating the frac-pump discharge from the mono line, while the first isolation valve 980A may provide a passive, one-way barrier from the mono line. The passive valve 980A may be configured to permit flow toward the mono line when the upstream, pump-side pressure exceeds the downstream, mono line pressure by at least a cracking pressure, for example, between about 0.5 and 5 psi, and to automatically and passively close when the downstream pressure becomes greater than the upstream pressure. The closure of valve 980A may be effected solely by the reversal of differential pressure and may require no hydraulic or electrical actuation, thereby maintaining sealing integrity even if power or hydraulic control systems are de-energized. When closed, the valve 980A may prevent backflow of high pressure fluid from the mono line into the pumps or piping of a deactivated zone.

This configuration may allow a selected zone to be isolated and depressurized more efficiently and with reduced risk of valve damage. Unlike hydraulically actuated gate valves (e.g., FIGS. 8A-8B), which can experience erosion, galling, or seat damage when opened under high differential pressure, the one-way valve 980A operates passively and is designed to open only when the pressure differential across it exceeds the cracking threshold. The passive design thus eliminates the need for manual or operator-dependent pressure equalization before valve actuation and removes the possibility of opening a high-pressure gate valve against a large differential pressure. Because valve 980A does not require an external actuator or accumulator, the hydraulic system supporting each zone may be simplified, reducing component count, cost, and maintenance requirements.

To deactivate a selected zone equipped with the assembly 280 of FIGS. 9A-9B, the control system may initiate a compartment isolation and bleed down sequence. The frac pumps of the selected zone may first be ramped down to 0 BPM and electrically isolated by disengaging variable frequency drives (VFDs) and opening circuit breakers at the switch gear transport (e.g., 112). Once power is removed, the mono line-side passive valve 980A may close automatically because the mono-line pressure downstream is greater than the pressure in the isolated zone.

The control system or site personnel may also close the pump-side hydraulic gate valve 980B to double isolate the pumps from the monoline. The trapped high-pressure fluid between the pumps and the pressure control assembly 280 may then be relieved through the zone's bleed assembly 295, which may include a gate-type BAT (Bleed-Air-Transducer) system or a wrap-around bleed-off system with plug valves and a choke.

In the BAT arrangement, a first bleed valve may direct flow from the isolated segment through a restricted choke path to a bleed tank, gradually reducing pressure to a controlled threshold (for example, about 1,500 psi). Once the pressure reaches this level, a second bleed valve may open a larger bypass line, or "gut line," to rapidly vent the remaining fluid to atmosphere. In the wrap-around bleed arrangement, the bleed assembly 295 may employ inside, outside, and bypass plug valves arranged so that when opened sequentially, they form a continuous flow path from the isolated segment to a bleed tank through a positive choke, as well as a bypass line. Both bleed assembly configurations enable controlled depressurization of the isolated leg without disconnecting high pressure iron or moving equipment. Pressure transducer 985 may continuously monitor the declining pressure to verify successful bleed-down and transmit data to the data van or other control interface. When the pressure reaches near-atmospheric levels, the compartment may be considered safely isolated and may be serviced.

During maintenance, the passive one-way valve 980A remains closed, providing an automatic primary seal against backflow from the mono line. This ensures that pressure from adjacent active zones cannot enter the isolated segment even if the gate valve 980B is inadvertently opened or loses hydraulic containment. The gate valve 980B acts as a secondary barrier and remains locked in the closed position throughout maintenance. The dual-valve arrangement therefore maintains redundant protection of personnel and equipment within the deactivated zone.

After maintenance or inspection, the zone may be reactivated following the compartment restart procedure. The bleed assembly 295 may first be secured by closing the choke and bypass valves, and removing locks from the actuators of gate valve 980B. The pumps may be energized, and priming steps may be performed as described previously to prime the low-pressure and high-pressure lines of the zone. Further, the gate valve 980B may be opened to allow the pumps to charge the high-pressure leg with clean fluid. As the pumps build pressure, the transducer 985 may monitor the differential across valve 980A. When the pump-side pressure exceeds the mono-line pressure by the cracking pressure, valve 980A may automatically open, re-establishing flow communication to the mono line. No manual equalization or hydraulic actuation of the mono-line-side valve may be required. If pump pressure drops, valve 980A may automatically reclose to prevent backflow. Because valve 980A responds passively and precisely to differential pressure, re-pressurization and restart operations may be faster and less error-prone than in dual-gate systems.

In certain embodiments, the control system may use the signal from the pressure transducer 985 to confirm the exact moment of cracking and to verify that the valve 980A has opened. The control system may also record differential pressure data to assess valve performance or detect anomalies such as delayed cracking, hysteresis, or potential debris obstruction. This information may be used for predictive maintenance of the pressure control assembly 280, bleed assembly 295, or to alert operators if reactivation does not proceed as expected.

The pressure control assembly 280 illustrated in FIGS. 9A and 9B thus enables a compartmentalized hydraulic fracturing system to maintain operational continuity while reducing component wear, actuation complexity, and downtime. The use of a passive one-way isolation valve eliminates the need for hydraulically actuating a gate valve under differential pressure, thereby avoiding erosion and seal damage. The arrangement of gate valve 980B and one-way valve 980A in series provides both active and passive isolation, and the incorporation of pressure transducer 985 allows precise monitoring and control of the isolation and restart process. This configuration provides full compliance with safety requirements for redundant barriers, enables predictable isolation and reactivation sequences through differential-pressure-driven operation, and may be implemented with various valve geometries, flow orientations, or actuation mechanisms that perform the same functional operations described herein.

The embodiments shown in FIGS. 9A and 9B may be implemented in a variety of compartmentalized hydraulic fracturing systems and provide structural and functional arrangements that enable safe, efficient, and redundant isolation of individual zones during high pressure operations. Each zone may connect to a mono line configured to carry frac fluid into a well, the zone including one or more frac pumps supplying high pressure fluid, and a pressure control assembly having a first isolation valve and a second isolation valve fluidly coupled in series between the pumps and the mono line. The first isolation valve may be a passive, one-way valve positioned between the second isolation valve and the mono line and may be configured to open and close automatically in response to a differential pressure across the valve. The second isolation valve may be an actively controlled valve, such as a hydraulically actuated gate valve, positioned on the pump side of the pressure control assembly to selectively open or close the flow path between the frac pumps and the mono line. Each zone may further include one or more bleed valves or bleed assemblies configured to release pressurized fluid from the zone, and a control system may selectively deactivate and reactivate each zone. Each zone may further include low pressure isolation and bleed valves or assemblies for priming the zone or for depressurization of the low-pressure lines. Partition walls may be positioned between adjacent zones to provide physical separation and protection for personnel, and one or more pressure or flow sensors may be integrated into the system to monitor valve performance, line pressure, and zone status. Collectively, these features and components provide a compartmentalized hydraulic fracturing system capable of maintaining high pressure operations in active zones while safely isolating and servicing individual deactivated zones.

Example Control System

Figure 4:
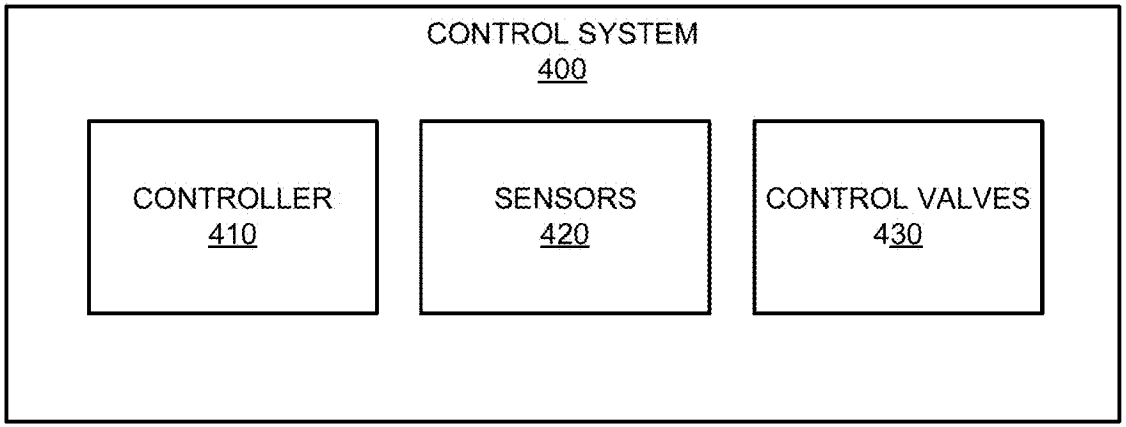
FIG. 4 is a block diagram of a control system of a compartmentalized frac system, in accordance with one or more embodiments.

FIG. 4 is a block diagram of a control system 400 of a compartmentalized frac system, in accordance with one or more embodiments. The control system 400 illustrated in FIG. 4 may be operable with any of the illustrated frac systems (e.g., system 103, 200, 300) and pressure control assemblies according to the present disclosure.

In one or more embodiments, the control system 400 includes a controller 410, sensors 420, and valves 430. The sensors 420 (e.g., flow rate sensors, pressure sensors, temperature sensors, position sensors, vibration sensors (e.g., coupled to frac pumps) and the like) may measure various metrics in a compartmentalized frac system. For example, sensors in a zone may generate data indicative of the pressure or flow rate of frac fluid in the zone. In another example, a position sensor may generate data indicative of the position of a valve, such as whether a valve (e.g., of assemblies 280 or 295) is in an open or closed position. Each zone of a compartmentalized frac system may include the same or a similar set of one or more sensors 420 that enable the control system 400 to, based on data from the sensors, determine a service condition has occurred, perform deactivation operations for a zone, determine a condition to confirm a deactivation process for a zone is complete, determine a condition to begin a reactivation process for a zone, perform reactivation operations for a zone, determine a condition to confirm a reactivation process for a zone is complete, or any combination thereof. Components not in a zone may also include sensors that enable the control system 400 to perform the above operations. For example, a mono line (e.g., 260) may include one or more flow rate sensors or pressure sensors.

The controller 410 (e.g., a programmable logic controller) may be configured to control an operation of the compartmentalized frac system (e.g., by determining, generating and/or transmitting control instructions to one or more components of the compartmentalized frac system associated with that operation). For example, the controller 410 can shut off or disconnect power to one or more frac pumps in a zone.

The controller 410 may control an operation based on sensor data generated by one or more of the sensors 420. For example, based on sensor data, the controller 410 controls frac pumps in one or more zones such that the flow rate (or pressure) in the high-pressure mono line is within a target flow rate (or pressure) range (e.g., within 5% or 10% of a target value), for example, even if one or more other zones are being deactivated or reactivated. In another example, based on vibration sensor data from vibration sensors coupled to frac pumps, the controller 410 controls the frac pumps to balance harmonics of the system. In another example, the sensors 420 may generate data indicative of an operation state of frac pumps (e.g., 205) in a zone, and the controller 410 may be configured to change the operational state of the frac pumps (e.g., during a deactivation or reactivation process). In another example, responsive to a sensor indication that an isolation valve for a zone is closed, the controller 410 may be configured to open a bleed valve for that zone to depressurize that zone. In another example, the controller 410 adjusts a pump speed of a frac pump based on sensor data of a vibration sensor coupled to that frac pump.

The control valves 430 may be operable by the controller 410. Example control valves include isolation valves (e.g., 280) and bleed valves (e.g., 295). The controller 410 may automatically operate (e.g., via (e.g., electric or hydraulic) actuators, electric motors) an isolation valve 280 or bleed valve 295 for a zone (or all zones).

Example Method of Operating a Compartmentalized Frac System

Figure 5:
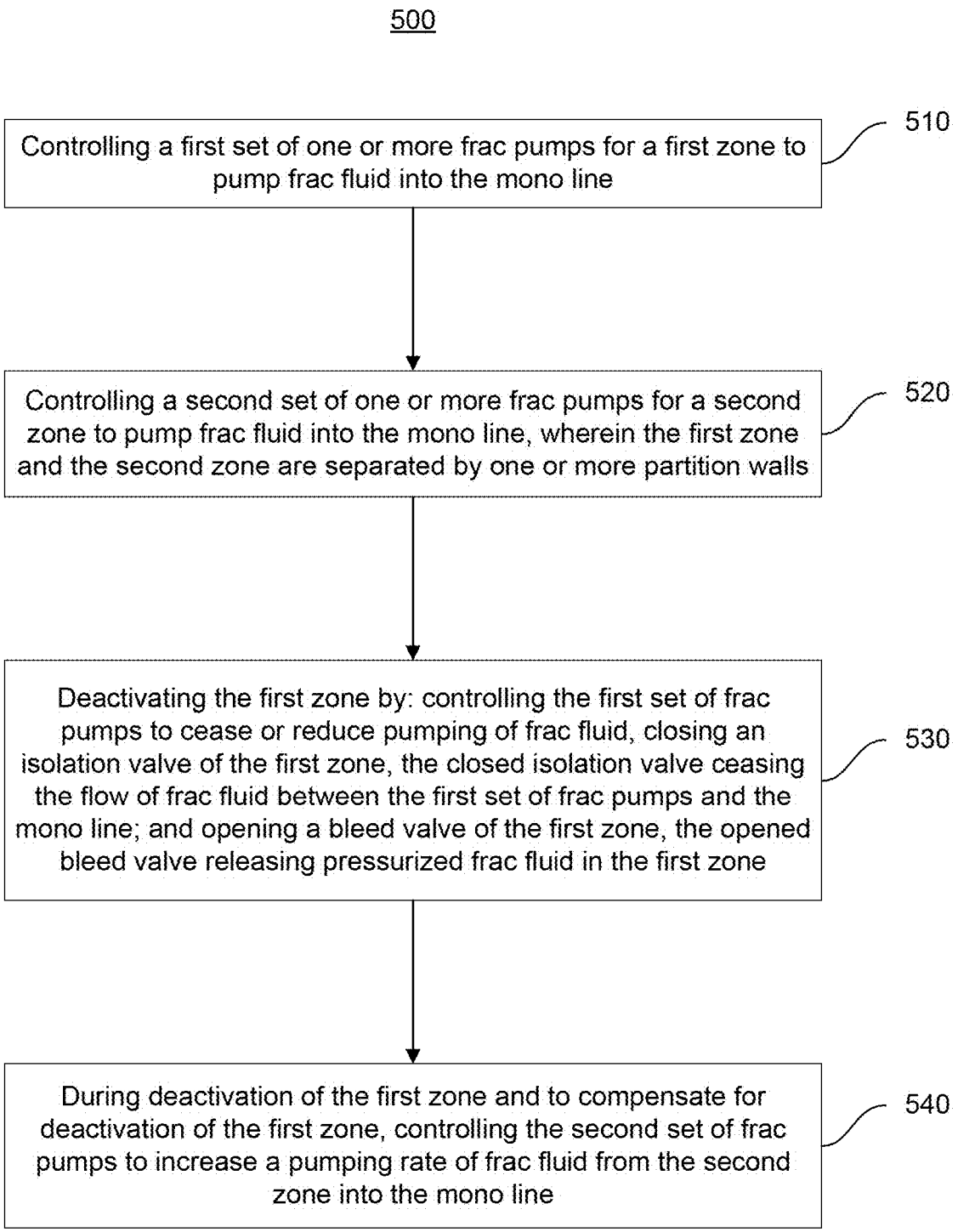
FIG. 5 is a flow chart illustrating a process for operating a compartmentalized frac system, in accordance with one or more embodiments.

FIG. 5. is a flowchart for a method 500 for operating a compartmentalized frac system, in accordance with one or more embodiments. The example method of FIG. 5 is performed from the perspective of a control system (e.g., 400), however this is not required. The method can include additional, fewer, or different steps than described. Additionally, the steps can be performed in different order, or by different components than described herein.

FIG. 5 is a flowchart of an example method for (e.g., remotely) controlling (e.g., deactivating) a first zone of a set of zones of a compartmentalized hydraulic fracturing (frac) system, the compartmentalized frac system comprising a mono line configured to carry frac fluid into a wellbore.

At step 510, the control system controls a first set of one or more frac pumps for a first zone to pump (e.g., high-pressure) frac fluid into the mono line.

At step 520, the control system (e.g., in conjunction with controlling the first set of frac pumps) controls a second set of one or more frac pumps for a second zone to pump frac fluid into the mono line, wherein the first zone and the second zone are separated by one or more partition walls.

At step 530, the control system deactivates the first zone by: controlling the first set of frac pumps to cease or reduce pumping of frac fluid, closing an (e.g., high-pressure) isolation valve of the first zone, the closed isolation valve ceasing the flow of frac fluid between the first set of frac pumps and the mono line; and opening a (e.g., high-pressure) bleed valve of the first zone, the opened bleed valve releasing pressurized frac fluid in the first zone.

At step 540, the control system, during deactivation of the first zone and to compensate for deactivation of the first zone, controls the second set of frac pumps to increase a pumping rate of frac fluid from the second zone into the mono line.

In some aspects, the method further includes: reactivating the first zone by: responsive to completion of a reactivation condition, controlling the first set of frac pumps to begin or increase pumping frac fluid; subsequent to completion of a priming condition of the first zone, closing the bleed valve; controlling the first set of frac pumps to adjust the frac fluid pressure in the first zone to a target pressure based on the frac fluid pressure in the mono line; and subsequent to the frac fluid pressure in the first zone reaching the target pressure, opening the isolation valve, the opened isolation valve enabling the flow of frac fluid between the set of frac pumps and the mono line; and during reactivation of the first zone and to compensate for reactivation of the first zone, controlling the second set of frac pumps to decrease the pumping rate of frac fluid from the second zone into the mono line.

In some aspects, the method further includes controlling a blender transport to pump frac fluid into a (e.g., low-pressure) second line configured to carry (e.g., low-pressure) frac fluid from the blender transport to the first set of one or more frac pumps; and wherein deactivating the first zone further includes: (e.g., after the pumps cease pumping and after the (e.g., high-pressure) isolation valve is closed) closing a second (e.g., low-pressure) isolation valve at the second line, the second isolation valve configured to control the flow of frac fluid between the blender transport and the first set of frac pumps; and (e.g., in conjunction with opening of the (e.g., high-pressure) bleed valve) opening a (e.g., low-pressure) second bleed valve configured to release pressurized frac fluid in a segment of the second line between the second isolation valve and the first set of one or more frac pumps.

Figure 10:
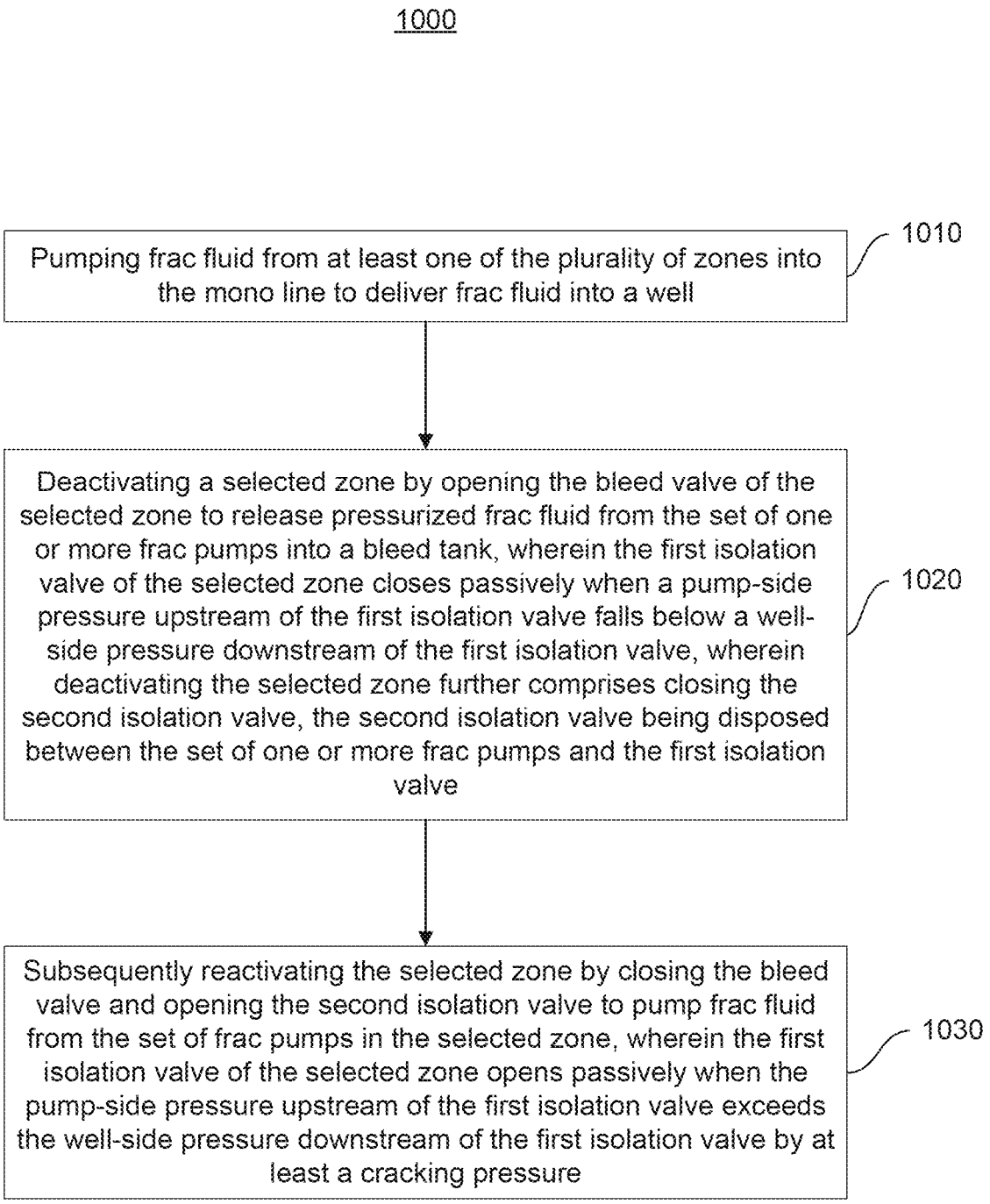
FIG. 10 is a flow chart illustrating a process for operating another compartmentalized frac system, in accordance with one or more embodiments.

FIG. 10 illustrates an example method 1000 for operating a compartmentalized hydraulic fracturing system equipped with one or more pressure control assemblies 280 as described in connection with FIGS. 9A-9B. Method 1000 may be executed manually, automatically, or semi-automatically under the direction of a control system 400 and may be implemented using the components, valves, and control logic previously described. The method allows selective deactivation and reactivation of individual zones while maintaining high pressure fracturing operations in other zones connected to a mono line configured to carry frac fluid into a well.

At step 1010, a control system 400 may carry out pumping operations out in which one or more zones of the system 200 deliver frac fluid into the mono line 250, 260 through corresponding pressure control assemblies 280. Each zone may include a set of frac pumps 205 operating at a controlled flow rate and pressure to maintain a target downhole treating pressure. In some embodiments, the pumps may discharge frac fluid through the pump-side, hydraulically actuated gate valve 980B and the passive one-way isolation valve 980A of the pressure control assembly 280, which together may provide continuous flow communication to the mono line 260 while maintaining redundant isolation capability. A control system 400 may receive input from pressure transducers 985 positioned along the high pressure legs and additional pressure sensors on the mono line to regulate each zone's flow rate to balance system pressure across the mono line. Adjacent zones may be separated by partition walls 230 and 240 may remain active and continue pumping at compensated rates even as one or more zones are selected for isolation.

At step 1020, a control system 400 may deactivate a selected zone. Deactivation may be initiated in response to a service condition such as a scheduled maintenance event, sensor-detected failure, or operator instruction. The control system 400 may command the VFDs and power disconnects associated with the pumps 205 in the selected zone to ramp down to zero revolutions per minute and de-energize the motors. As the pumps stop, the pressure on the pump side of the pressure control assembly 280 may decrease. When the pump-side pressure falls below the well-side pressure in the mono line 260, the mono-line-side one-way valve 980A may close automatically and passively, forming an automatic barrier that prevents high-pressure fluid in the mono line from back-flowing into the isolated zone. The confined volume of high-pressure fluid trapped in the selected zone due to closure of the valve 980A may be vented through a bleed assembly 295 fluidly coupled to that segment or zone. The pump-side gate valve 980B may also be actuated hydraulically to the closed position, providing a secondary isolation barrier between the pumps and the mono line.

Depressurization of the isolated zone may be performed through a bleed-air-transducer (BAT) system or a wrap-around bleed-off system. In the BAT configuration, the control system 400 may control a first bleed valve to direct flow through a restricted choke path to a bleed tank 270 to reduce pressure gradually to a controlled threshold (for example, about 1,500 psi). After the pressure has decreased to the threshold level, a second bleed valve may open a bypass or "gut line" that allows rapid venting of the remaining fluid to atmosphere. In the wrap-around configuration, inside, outside, and bypass plug valves (bleed valves) may form a continuous path from the pumps to the bleed tank through a choke. Pressure transducers may monitor the declining pressure in real time to confirm safe bleed-down. When the measured pressure approaches atmospheric, the control system 400 may confirm full isolation and notify operators that the compartment is safe for entry. Because the first isolation valve 980A remains closed automatically, no manual valve actuation is required to seal against back-flow from the mono line during or after depressurization.

At step 1030, the control system 400 may reactivate the selected zone. After maintenance or inspection activities are complete, priming operations may be performed to prime low pressure and/or high pressure lines of the zone. For example, the control system 400 may perform a priming sequence by opening low-pressure isolation valves 281 and operating the pumps at a low rate to fill and purge air from the high-pressure leg while the bleed valves remain open. Once priming is verified through pressure stabilization, the control system 400 may control to close the bleed-off valves of assembly 295, unlock the hydraulic control circuit of gate valve 980B, and restore electrical power to the pumps 205. The control system 400 may perform a pressure test by operating the pumps to continue to build pressure against the closed gate valve 980B. After successful completion of the pressure test, the gate valve 980B may be opened, allowing the pumps to charge the high-pressure segment leading to the mono line. As pump pressure increases, the pressure transducer 985 measures the differential across the one-way valve 980A. When the pump-side pressure exceeds the mono-line pressure by at least the cracking pressure of the one-way valve (for example, between 0.5 and 5 psi), valve 980A opens automatically, re-establishing communication between the zone and the mono line. If pump pressure subsequently decreases, valve 980A recloses automatically to prevent back-flow, thereby maintaining continuous one-directional flow control without operator intervention.

Throughout reactivation, the control system 400 may monitor the pressure differential reported by transducer 985 to confirm that cracking occurs as expected and may record the event for diagnostic or maintenance purposes. Once the passive valve 980A has opened and stable flow to the mono line is detected, the pumps 205 may be ramped up to the desired operating pressure. Other zones may simultaneously ramp down to maintain a consistent total downhole pressure. Because the one-way valve 980A operates passively under differential pressure rather than by external hydraulic actuation, the reactivation process eliminates the equalization and manual opening steps required in systems that use two gate valves, reducing reactivation time and eliminating the potential for gate-seat erosion under high differential pressure.

Method 1000 therefore provides a sequence of pumping, deactivation, and reactivation operations that enables a compartmentalized fracturing system to continue high-pressure pumping in active zones while safely isolating individual zones for maintenance. The integration of an actively controlled gate valve 980B and a passive one-way valve 980A within each pressure control assembly 280 allows each zone to be isolated without manual intervention and to be brought back online automatically once the pump-side pressure exceeds the mono-line pressure by the valve's cracking pressure. The coordinated operation of the pumps 205, pressure control assemblies 280 including isolation valves 980A and 980B, bleed assemblies 295, sensors 985, and control system 400 ensures predictable pressure transitions, enhanced safety, and minimized downtime across the entire hydraulic fracturing fleet.

Other aspects include components, devices, systems, improvements, methods, processes, applications, computer readable mediums, and other technologies related to any of the above.

Computing Machine Architecture

Figure 6:
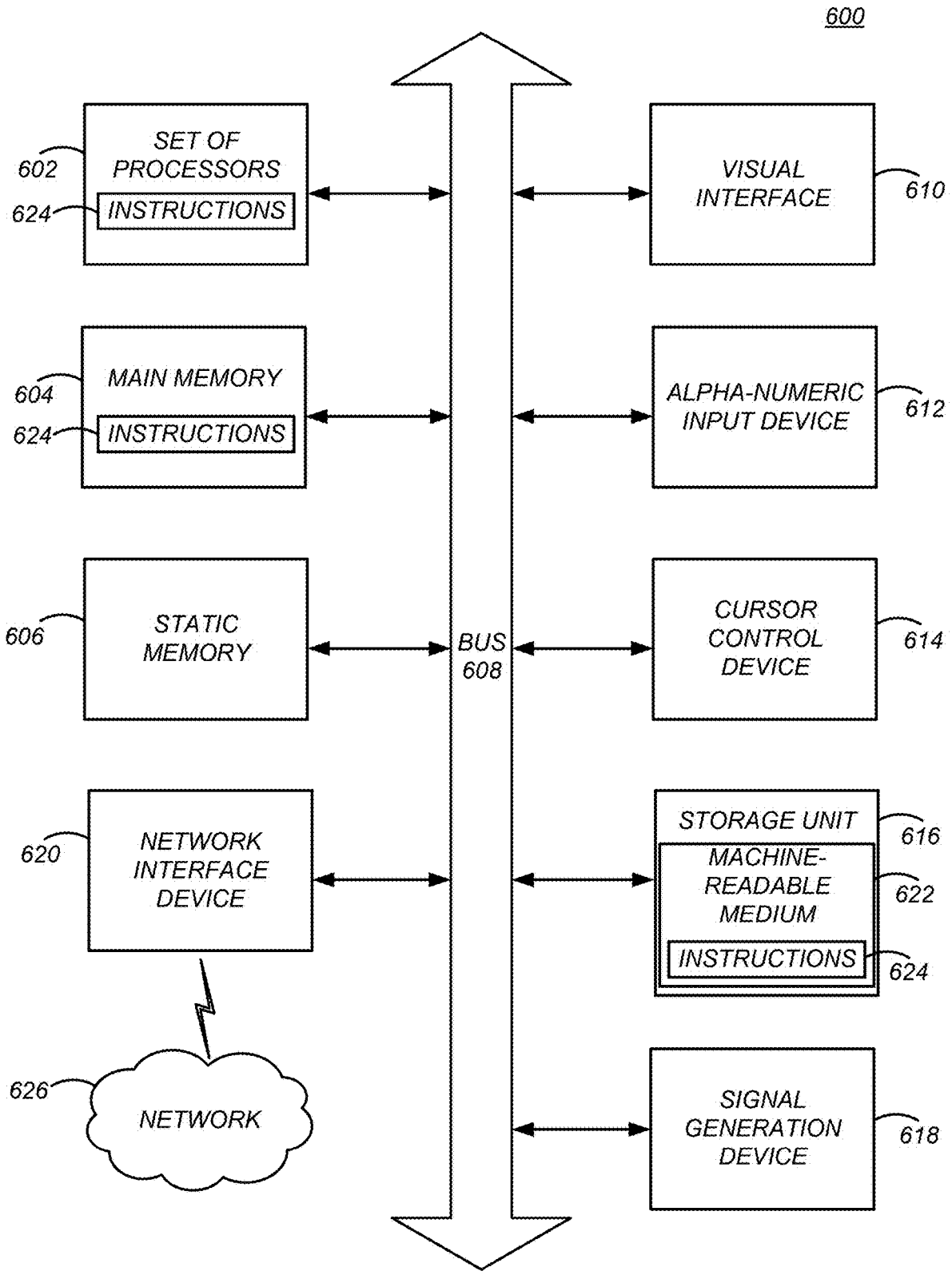
FIG. 6 is a block diagram illustrating components of an example machine able to read instructions from a machine-readable medium and execute them in a processor (or controller).

FIG. 6 is a block diagram illustrating components of an example machine able to read instructions from a machine-readable medium and execute them in a set of one or more processors (or controllers). Specifically, FIG. 6 shows a diagrammatic representation of a machine in the example form of a computer system 600 within which program code (e.g., software) for causing the machine to perform any one or more of the methodologies discussed herein may be executed. The program code may be comprised of instructions 624 executable by one or more processors 602. In alternative embodiments, the machine operates as a stand-alone device or may be connected (e.g., networked) to other machines. In a networked deployment, the machine may operate in the capacity of a server machine or a client machine in a server-client network environment, or as a peer machine in a peer-to-peer (or distributed) network environment. Control systems of compartmentalized frac systems described herein (e.g., 400) may be a computer system 600, part of a computer system 600, or include a computer system 600.

The machine may be a server computer, a client computer, a personal computer (PC), a tablet PC, a set-top box (STB), a personal digital assistant (PDA), a cellular telephone, a smartphone, a web appliance, a network router, switch or bridge, or any machine capable of executing instructions 624 (sequential or otherwise) that specify actions to be taken by that machine. Further, while only a single machine is illustrated, the term "machine" shall also be taken to include any collection of machines that individually or jointly execute instructions 624 to perform any one or more of the methodologies discussed herein.

The example computer system 600 includes a set of one or more processors 602 (e.g., one or more central processing units (CPUs), one or more graphics processing units (GPUs), one or more neural network processors (NNPs), one or more state machines, one or more digital signal processors (DSPs), one or more application specific integrated circuits (ASICs), one or more radio-frequency integrated circuits (RFICs), or any combination of these), a main memory 604, and a static memory 606, which are configured to communicate with each other via a bus 608. If the set of processors 602 includes multiple processors, the processors may operate individually or collectively to accomplish one or more operations. The computer system 600 may further include visual display interface 610. The visual interface may include a software driver that enables displaying user interfaces on a screen (or display). The visual interface may display user interfaces directly (e.g., on the screen) or indirectly on a surface, window, or the like (e.g., via a visual projection unit). For ease of discussion the visual interface may be described as a screen. The visual interface 610 may include or may interface with a touch enabled screen. The computer system 600 may also include alphanumeric input device 612 (e.g., a keyboard or touch screen keyboard), a cursor control device 614 (e.g., a mouse, a trackball, a joystick, a motion sensor, or other pointing instrument), a storage unit 616, a signal generation device 618 (e.g., a speaker), and a network interface device 620, which also are configured to communicate via the bus 608.

The storage unit 616 includes a (e.g., non-transitory) machine-readable medium 622 on which is stored instructions 624 (e.g., software) embodying any one or more of the methodologies or functions described herein. The instructions 624 (e.g., software) may also reside, completely or at least partially, within the main memory 604 or within the processor 602 (e.g., within a processor's cache memory) during execution thereof by the computer system 600, the main memory 604 and the processor 602 also constituting machine-readable media. The instructions 624 (e.g., software) may be transmitted or received over a network 626 via the network interface device 620.

While machine-readable medium 622 is shown in an example embodiment to be a single medium, the term "machine-readable medium" should be taken to include a single medium or multiple media (e.g., a centralized or distributed database, or associated caches and servers) able to store instructions (e.g., instructions 624). The term "machine-readable medium" shall also be taken to include any medium that is capable of storing instructions (e.g., instructions 624) for execution by the machine and that cause the machine to perform any one or more of the methodologies disclosed herein. The term "machine-readable medium" includes, but not be limited to, data repositories in the form of solid-state memories, optical media, and magnetic media.

Additional Configuration Considerations

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like.

Furthermore, it has also proven convenient at times, to refer to these arrangements of operations as modules, without loss of generality. The described operations and their associated modules may be embodied in software, firmware, hardware, or any combinations thereof.

Throughout this specification, some embodiments have used the expression "coupled" along with its derivatives. The term "coupled" is not necessarily limited to two or more elements being in direct physical or electrical contact. Rather, the term "coupled" may also encompass two or more elements that are not in direct contact with each other, but yet still co-operate or interact with each other.

The terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability. Any computing systems including multiple processors may operate the multiple processors individually or collectively.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A compartmentalized hydraulic fracturing system, comprising:

a mono line configured to carry frac fluid into a well; and a plurality of zones, each zone comprising:

a set of one or more frac pumps configured to pump frac fluid into the mono line;

a first isolation valve and a second isolation valve, wherein the first and second isolation valves are fluidly coupled in series between the set of one or more frac pumps and the mono line, wherein the first isolation valve is positioned between the second isolation valve and the mono line, and wherein the first isolation valve is a passive, one-way valve configured to: (i) permit flow toward the mono line when a pump-side pressure upstream of the first isolation valve exceeds a well-side pressure downstream of the first isolation valve by at least a cracking pressure and (ii) automatically close to prevent flow from the mono line toward the set of one or more frac pumps in the zone without requiring hydraulic or electrical actuation; and a bleed valve configured to release pressurized frac fluid from the set of one or more frac pumps when in an open position, wherein the second isolation valve comprises a hydraulically actuated gate valve positioned between the set of one or more frac pumps and the first isolation valve.

2. The compartmentalized hydraulic fracturing system of claim 1, wherein the first isolation valve is a flapper check valve having a hinged flapper or disc that opens to permit flow toward the mono line when the pump-side pressure upstream of the first isolation valve exceeds the well-side pressure downstream of the first isolation valve by the cracking pressure and that pivots closed to prevent backflow toward the set of frac pumps when the well-side pressure exceeds the pump-side pressure.

3. The compartmentalized hydraulic fracturing system of claim 1, further comprising:

a control system configured to selectively deactivate or reactivate a zone of the plurality of zones by controlling the set of frac pumps, the second isolation valve, and the bleed valve of the zone.

4. The compartmentalized hydraulic fracturing system of claim 3, wherein each zone further comprises:

a low pressure line configured to carry frac fluid from a blender transport to the set of frac pumps;

a low pressure isolation valve on the low pressure line and configured to control flow of frac fluid between the blender transport and the set of frac pumps; and a low pressure bleed valve configured to release the frac fluid in a segment of the low pressure line between the low pressure isolation valve and the set of frac pumps when in an open position, wherein the control system is configured to, during reactivation of the zone, close the low pressure bleed valve, open the low pressure isolation valve, and operate the set of frac pumps to prime the zone.

5. The compartmentalized hydraulic fracturing system of claim 1, further comprising partition walls between the plurality of zones.

6. The compartmentalized hydraulic fracturing system of claim 1, wherein the bleed valve is a gate valve and wherein the compartmentalized hydraulic fracturing system further comprises in each zone, a bleed assembly including:

a first bleed valve fluidly coupled to the gate valve and configured to direct pressurized frac fluid through a restricted flow path or choke toward a bleed tank to gradually reduce pressure in the zone; and a second bleed valve fluidly coupled to the gate valve and configured to direct pressurized frac fluid through a bypass line that bypasses the restricted flow path to rapidly dump residual frac fluid to the bleed tank once the pressure in the zone has decreased to a selected threshold.

7. The compartmentalized hydraulic fracturing system of claim 1, wherein the bleed valve is a first plug valve and wherein the compartmentalized hydraulic fracturing system further comprises, for each zone, a wrap-around bleed assembly including:

the first plug valve;

a second plug valve connected in series to the first plug valve and downstream from the first plug valve in a bleed-off direction, the second plug valve fluidly connected to a bleed tank via a choke; and a third plug valve fluidly connecting the second plug valve to the bleed tank through a bypass line that bypasses the choke.

8. A method of operating a compartmentalized hydraulic fracturing (frac) system comprising a mono line and a plurality of zones, each zone including a set of one or more frac pumps, a first isolation valve and a second isolation valve fluidly coupled in series between the set of one or more frac pumps and the mono line, and a bleed valve, the method comprising:

pumping frac fluid from at least one of the plurality of zones into the mono line to deliver frac fluid into a well; and deactivating a selected zone by opening the bleed valve of the selected zone to release pressurized frac fluid from the set of one or more frac pumps into a bleed tank, wherein, for each zone, the first isolation valve is positioned between the second isolation valve and the mono line, and wherein the first isolation valve is a passive, one-way valve configured to: (i) permit flow toward the mono line when a pump-side pressure upstream of the first isolation valve exceeds a well-side pressure downstream of the first isolation valve by at least a cracking pressure and (ii) automatically close to prevent flow from the mono line toward the set of one or more frac pumps in the zone without requiring hydraulic or electrical actuation, wherein deactivating the selected zone further comprises closing the second isolation valve, the second isolation valve comprising a hydraulically actuated gate valve and being disposed between the set of one or more frac pumps and the first isolation valve.

9. The method of claim 8, further comprising:

subsequently reactivating the selected zone by closing the bleed valve and opening the second isolation valve to pump frac fluid from the set of frac pumps in the selected zone, wherein the first isolation valve of the selected zone opens passively when the pump-side pressure upstream of the first isolation valve exceeds the well-side pressure downstream of the first isolation valve by at least the cracking pressure.

10. The method of claim 8, wherein the first isolation valve of each zone is a flapper check valve having a hinged flapper or disc that opens to permit flow toward the mono line when the pump-side pressure upstream of the first isolation valve exceeds the well-side pressure downstream of the first isolation valve by the cracking pressure and that pivots closed to prevent backflow toward the set of frac pumps when the well-side pressure exceeds the pump-side pressure.

11. The method of claim 8, further comprising:

actuating the second isolation valve of a zone when selectively placing the zone in communication with or isolating the zone from the mono line.

12. The method of claim 8, further comprising deactivating the selected zone by:

opening a first bleed valve to direct pressurized frac fluid through a restricted flow path or choke toward a bleed tank to gradually reduce pressure in the selected zone, and after the pressure has decreased to a selected threshold, opening a second bleed valve to direct residual frac fluid through a bypass line that bypasses the restricted flow path to rapidly dump the residual frac fluid to the bleed tank.

13. The method of claim 8, wherein the bleed valve comprises a first plug valve, and wherein the method further comprises deactivating the selected zone by:

opening the first plug valve;

opening a second plug valve connected in series to the first plug valve and downstream from the first plug valve in a bleed-off direction, the second plug valve fluidly connected to a bleed tank via a choke; and opening a third plug valve fluidly connecting the second plug valve to the bleed tank through a bypass line that bypasses the choke.

14. The method of claim 8, wherein each zone further comprises a low pressure line configured to carry frac fluid from a blender transport to the set of frac pumps, a low pressure isolation valve and a low pressure bleed valve, and the method further comprises:

during reactivation of the selected zone, closing the low pressure bleed valve, opening the low pressure isolation valve and operating the set of frac pumps to prime the zone before closing the bleed valve and opening the second isolation valve.

15. An apparatus for isolating a zone of a compartmentalized hydraulic fracturing system, comprising:

a first isolation valve configured to pass flow in one direction and to automatically close to block flow in an opposite direction without requiring hydraulic or electrical actuation;

a second isolation valve fluidly coupled in series with the first isolation valve, the second isolation valve being selectively movable between an open position, in which flow is permitted from the zone to a frac-fluid conduit, and a closed position, in which flow is blocked; and a bleed valve fluidly coupled to the zone and configured, when opened, to release pressurized frac fluid from the zone to a bleed line or tank, wherein the first isolation valve is positioned between the second isolation valve and the frac-fluid conduit, and wherein the first isolation valve is a passive, one-way valve configured to: (i) permit flow toward the frac-fluid conduit when a pump-side pressure upstream of the first isolation valve exceeds a well-side pressure downstream of the first isolation valve by at least a cracking pressure, and (ii) automatically close to prevent flow toward the zone when the well-side pressure exceeds the pump-side pressure, and wherein the second isolation valve comprises a hydraulically actuated gate valve positioned between the zone and the first isolation valve.

16. The apparatus of claim 15, wherein the first isolation valve comprises a flapper check valve having a hinged flapper or disc.

* * * * *